US009024715B2

(12) United States Patent
Nishikawa et al.

(10) Patent No.: US 9,024,715 B2
(45) Date of Patent: May 5, 2015

(54) POWER CONVERTING TRANSFORMER, VEHICLE HEADLIGHT PROVIDED WITH THE POWER CONVERTING TRANSFORMER AND MOTOR VEHICLE PROVIDED WITH THE HEADLIGHT

(71) Applicant: Panasonic Corporation, Osaka (JP)

(72) Inventors: Masahiro Nishikawa, Niigata (JP); Tomoyuki Nakano, Niigata (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 13/861,288

(22) Filed: Apr. 11, 2013

(65) Prior Publication Data

US 2013/0271253 A1 Oct. 17, 2013

(30) Foreign Application Priority Data

Apr. 12, 2012 (JP) ..... 2012-091447

(51) Int. Cl.

| | |
|---|---|
| ***H01F 5/00*** | (2006.01) |
| ***H01F 27/24*** | (2006.01) |
| ***H01F 17/04*** | (2006.01) |
| ***H01F 27/02*** | (2006.01) |

(Continued)

(52) U.S. Cl.

CPC ..... *H01F 27/008* (2013.01); *H01F 27/263* (2013.01); *H01F 2027/2819* (2013.01)

(58) Field of Classification Search

CPC . H01F 27/2804; H01F 17/0013; H01F 5/003; H01F 41/041; H01F 41/046

USPC ..... 336/200, 212, 221, 83

See application file for complete search history.

(56) References Cited

U.S. PATENT DOCUMENTS 4,583,068 A * 4/1986 Dickens et al. ..... 336/82
2004/0223283 A1* 11/2004 Hsin ..... 361/160

(Continued)

FOREIGN PATENT DOCUMENTS

JP S62-135413 8/1987
JP S62-135414 8/1987

(Continued)

OTHER PUBLICATIONS

Korean Office Action dated Sep. 25, 2014 issued in a corresponding Korean application No. 10-2013-0040321 and the English summary thereof.

*Primary Examiner* — Elvin G Enad
*Assistant Examiner* — Kazi Hossain
(74) *Attorney, Agent, or Firm* — Renner, Otto, Boisselle & Sklar, LLP

(57) ABSTRACT

In a power converting transformer, an I-core has a pair of fixing grooves provided at centers on opposite side surfaces of the I-core in a y-direction in an xyz orthogonal coordinate system, the fixing grooves extending through the I-core in the z-direction, and an E-core has a pair of fixing recess portions provided at x-direction centers of the y-direction opposite end portions of the base portion on a surface opposite from a surface of the base portion facing the I-core. The I-core and the E-core are pressed and fixed to each other by a fixing spring wrapped around the I-core and the E-core through the fixing grooves and the fixing recess portions. An x-direction length of the E-core is shorter than an x-direction length of the I-core, and a y-direction length of the E-core is shorter than or equal to a y-direction distance between the fixing grooves of the I-core.

11 Claims, 30 Drawing Sheets

(51) Int. Cl.

| | |
|---|---|
| ***H01F 27/00*** | (2006.01) |
| ***H01F 27/26*** | (2006.01) |
| *H01F 27/28* | (2006.01) |

(56) References Cited

U.S. PATENT DOCUMENTS

| | | | | |
|---|---|---|---|---|
| 2006/0197644 | A1* | 9/2006 | Lin | 336/212 |
| 2008/0067415 | A1* | 3/2008 | Asano | 250/440.11 |
| 2009/0045683 | A1* | 2/2009 | Vermeulen et al. | 310/14 |
| 2010/0085139 | A1* | 4/2010 | Yan et al. | 336/221 |
| 2010/0237973 | A1* | 9/2010 | Cheng et al. | 336/83 |

FOREIGN PATENT DOCUMENTS

| | | | |
|---|---|---|---|
| JP | S63-016412 | | 2/1988 |
| JP | H02-138712 | | 5/1990 |
| JP | H06-69010 | B2 | 8/1994 |
| JP | 2002-208519 | | 7/2002 |
| JP | 2005-175064 | | 6/2005 |
| JP | 2005175064 | * | 6/2005 |
| KR | 10-2007-0120905 | A | 12/2007 |

* cited by examiner

E-CORE MISALIGNED IN X-DIRECTION

E-CORE MISALIGNED IN MINUS X-DIRECTION

I-CORE

E-CORE

POWER CONVERTING TRANSFORMER, VEHICLE HEADLIGHT PROVIDED WITH THE POWER CONVERTING TRANSFORMER AND MOTOR VEHICLE PROVIDED WITH THE HEADLIGHT

FIELD OF THE INVENTION

The present invention relates to a power converting transformer having an I-core and an E-core, a vehicle headlight provided with the power converting transformer and a motor vehicle provided with the vehicle headlight.

BACKGROUND OF THE INVENTION

Along with the size reduction of electronic devices, electronic parts mounted on a printed wiring board are becoming smaller in size and thickness. For instance, there is a tendency that a power converting transformer formed by winding a coil around a bobbin is converted to a thin sheet-like transformer.

The sheet-like transformer includes, e.g., a coil pattern formed on a printed wiring board, a pair of transformer cores arranged to grip the coil pattern therebetween and a clip or a fixing spring for joining the transformer cores together (see, e.g., Japanese Patent Application Publication No. 2005-175064). The transformer cores include, e.g., an I-core and an E-core. An inductance value is controlled by adjusting a gap length of outer leg portions or a central leg portion of the E-core.

In the sheet-like transformer disclosed in the above-cited reference, however, the I-core and the E-core are configured to have the same external dimension. For this reason, the I-core and the E-core are likely to get out of alignment with each other. As a result, the amount of leaked magnetic fluxes is increased in the transformer, which may possibly lead to a transformation loss. In an extraordinarily high temperature region, there is a likelihood that a circuit may be destroyed due to an increase in transformation loss and an increase in electric current caused by magnetic saturation.

SUMMARY OF THE INVENTION

In view of the above, the present invention provides a power converting transformer having an I-core and an E-core, which is capable of suppressing occurrence of problems caused by misalignment between the I-core and the E-core.

In accordance with an aspect of the present invention, there is provided a power converting transformer including: a substantially rectangular flat I-core extending along an x-y plane in an xyz orthogonal coordinate system; and an E-core including a substantially rectangular flat base portion extending along the x-y plane, a central leg portion installed upright at a center of the base portion to extend in a z-direction, and a pair of outer leg portions installed upright in opposite end portions of the base portion in a y-direction to extend in the z-direction. The I-core is placed on the outer leg portions. The I-core includes a pair of fixing grooves provided at centers on opposite side surfaces of the I-core in the y-direction. The fixing grooves extend through the I-core in the z-direction. The E-core includes a pair of fixing recess portions provided at x-direction centers of the y-direction opposite end portions of the base portion on a surface opposite from a surface of the base portion facing the I-core. The I-core and the E-core are pressed and fixed to each other by a fixing spring wrapped around the I-core and the E-core through the fixing grooves and the fixing recess portions. An x-direction length of the E-core is shorter than an x-direction length of the I-core, and a y-direction length of the E-core is shorter than or equal to a y-direction distance between the fixing grooves of the I-core.

The y-direction distance between the fixing grooves of the I-core may be equal to the y-direction length of the E-core.

The x-direction length of the I-core may be defined by an x-direction length of the E-core, an x-direction length of the fixing recess portions of the E-core, an x-direction length of the fixing grooves of the I-core and an x-direction width of the fixing spring.

The x-direction length of the I-core may be larger than or equal to the x-direction length of the E-core added by the x-direction length of the fixing recess portions of the E-core and the x-direction length of the fixing grooves of the I-core and subtracted by the double of the x-direction width of the fixing spring.

The I-core may include a fit-in groove into which the fixing spring is fitted, the fit-in groove formed on a surface of the I-core opposite from a surface of the I-core facing the E-core, the fit-in groove extending in the y-direction to interconnect the fixing grooves.

The E-core may include an anti-short-circuit groove provided in the base portion near a circumferential edge of the central leg portion to prevent the E-core from being short-circuited with a coil pattern of a wiring board interposed between the I-core and the E-core.

In accordance with another aspect of the present invention, there is provided a power converting transformer including: a substantially rectangular flat I-core extending along an x-y plane in an xyz orthogonal coordinate system; and an E-core including a substantially rectangular flat base portion extending along the x-y plane, a central leg portion installed upright at a center of the base portion to extend in a z-direction, and a pair of outer leg portions installed upright in opposite end portions of the base portion in a y-direction to extend in the z-direction. The I-core is placed on the outer leg portions. The I-core includes a fit-in groove into which a fixing spring is fitted, and the fit-in groove is formed on a surface of the I-core opposite from a surface of the I-core facing the E-core. The E-core includes a pair of fixing recess portions provided at x-direction centers of the y-direction opposite end portions of the base portion on a surface opposite from a surface of the base portion facing the I-core. The I-core and the E-core are pressed and fixed to each other by the fixing spring wrapped around the I-core and the E-core through the fit-in groove and the fixing recess portions. An x-direction length of the E-core is shorter than an x-direction length of the I-core, and a y-direction length of the E-core is shorter than a y-direction length of the I-core.

In accordance with still another aspect of the present invention, there is provided a vehicle headlight including the aforementioned power converting transformer.

In accordance with still another aspect of the present invention, there is provided a motor vehicle including the vehicle headlight.

With the present invention, the I-core is larger in size than the E-core. For this reason, even if the E-core is slightly misaligned with respect to the I-core, the E-core seldom protrudes beyond the I-core. As a result, it becomes possible to suppress occurrence of problems caused by misalignment. Accordingly, it is possible to reduce a change in the electric characteristics of the transformer and a power loss in the circuit, thereby enhancing the power converting efficiency and reliability of the transformer.

DETAILED DESCRIPTION OF THE EMBODIMENTS

Figure 1:
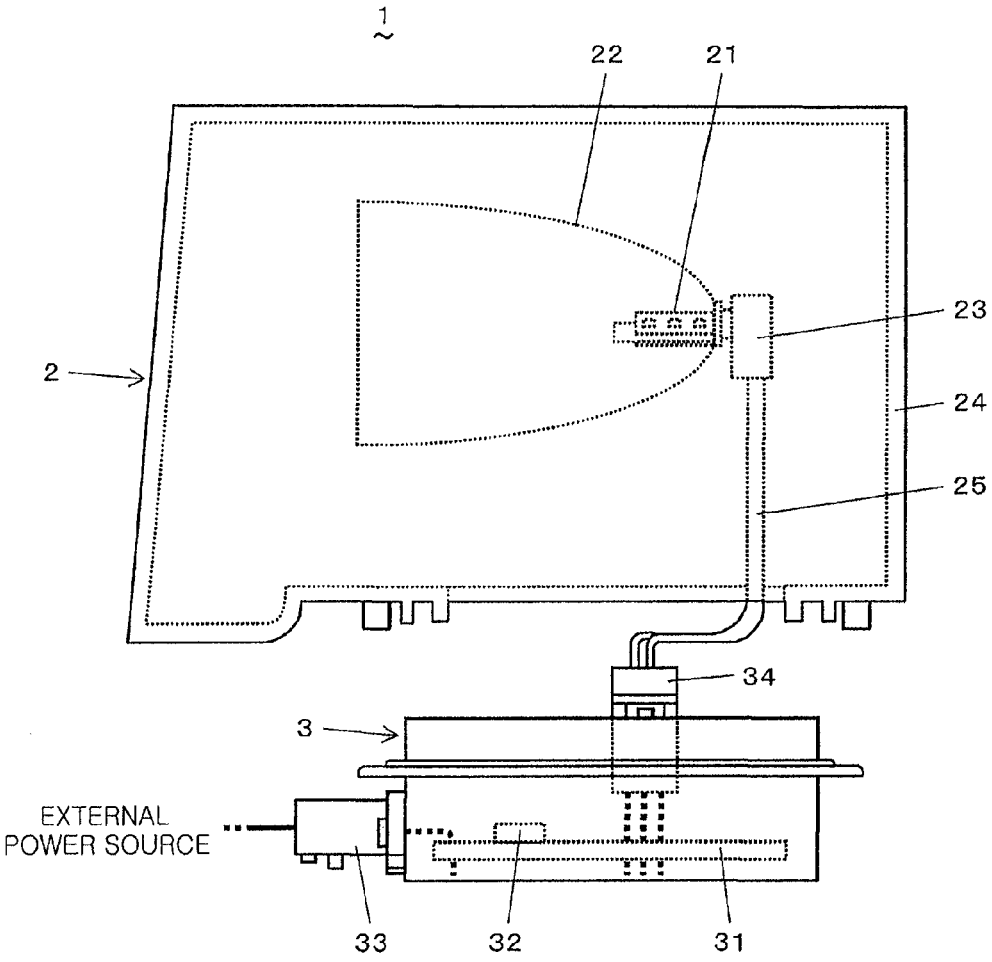
FIG. 1 is a side view showing a vehicle headlight according to a first embodiment of the present invention.

A motor vehicle according to a first embodiment of the present invention, a vehicle headlight mounted to a motor vehicle and a power converting transformer making up the vehicle headlight will now be described with reference to FIGS. 1 through 11F. As shown in FIG. 1, a vehicle headlight 1 includes a lamp device 2 and a lighting device 3 for controlling the lighting of the lamp device 2.

The lamp device 2 includes a high intensity discharge lamp 21 serving as a light source, a reflector plate 22 for reflecting the light emitted from the discharge lamp 21 to form a specified light distribution pattern, an igniter 23 for causing the discharge lamp 21 to start a discharge operation, and a casing 24 for accommodating the discharge lamp 21, the reflector plate 22 and the igniter 23. The discharge lamp 21 is connected to the lighting device 3 via the igniter 23 by means of a power cable 25.

The reflector plate 22 is arranged to surround the discharge lamp 21 to reflect the light emitted from the discharge lamp 21 toward the front side (toward the left side in FIG. 1). The inner surface of the reflector plate 22 is made of a material with superior light reflectivity, e.g., aluminum. The igniter 23 includes a transformer having a large winding ratio of a primary side to a secondary side. As a voltage is supplied from the lighting device 3, the igniter 23 applies a high-voltage pulse of about 20,000 V to the discharge lamp 21, thereby causing the discharge lamp 21 to start a discharge operation. At least the front surface of the casing 24 (the left surface on the drawing sheet), on which the light coming from the discharge lamp 21 is irradiated, is made of a light-transmitting material, e.g., a transparent polycarbonate resin or a transparent acryl resin.

The lighting device 3 includes a circuit board 31 for controlling electric power supplied to the lamp device 2, a control unit 32 for controlling an operation of the circuit board 31, an input connector 33 through which electric power is supplied from the outside to the circuit board 31 and an output connector 34 through which electric power is supplied from the circuit board 31 to the lamp device 2. The output connector 34 led out from the lighting device 3 is connected to a power cable 25 of the lamp device 2.

Figure 2:
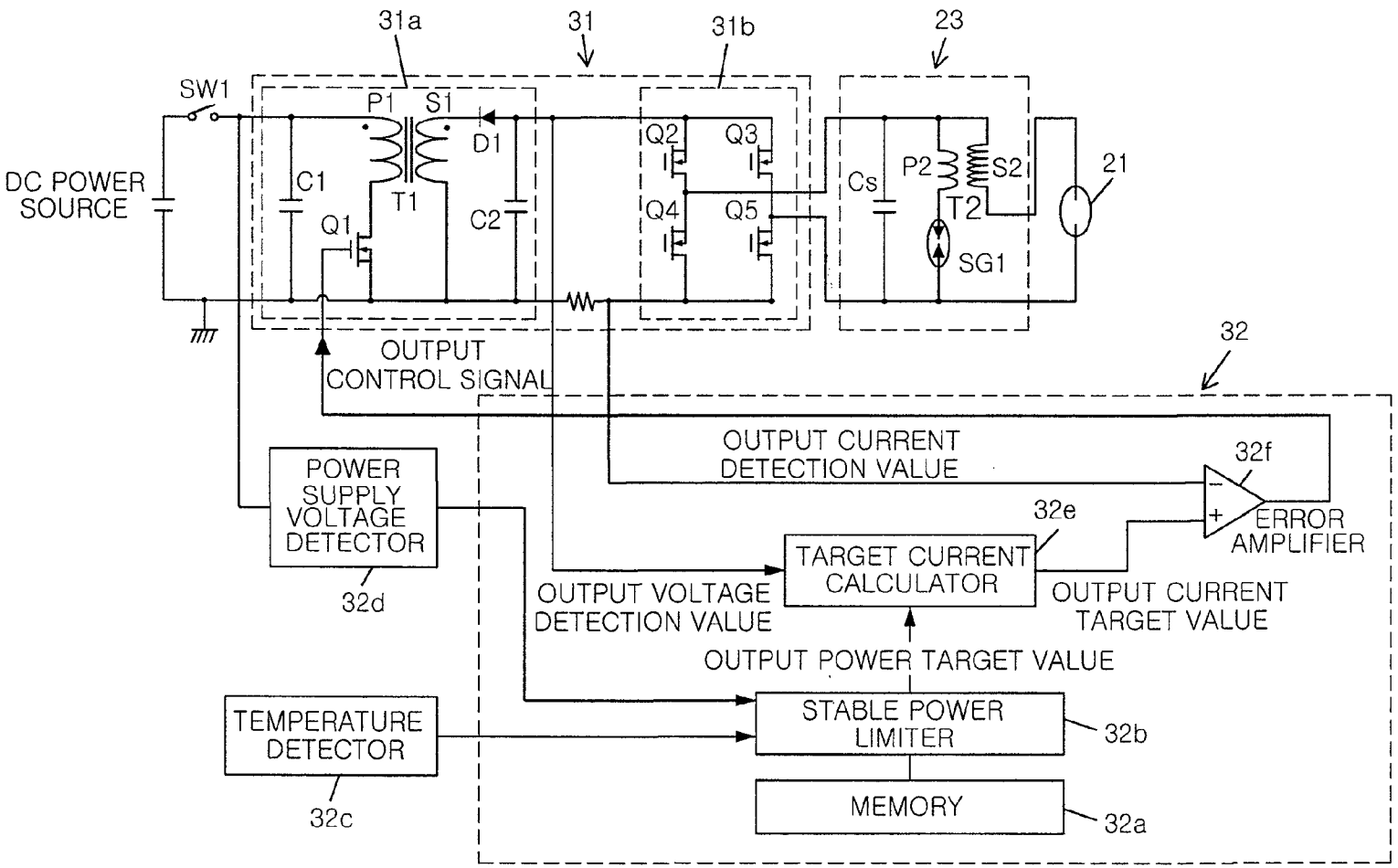
FIG. 2 is a circuit diagram of the vehicle headlight.

As shown in FIG. 2, the circuit board 31 includes a fly-back type DC-DC converter 31*a* for increasing and decreasing a voltage supplied from a DC power source, and a full-bridge inverter 31*b* for converting a DC output voltage of the DC-DC converter 31*a* to a low-frequency rectangular wave. The DC-DC converter 31*a* converts the voltage supplied from the DC power source to a drive voltage for the discharge lamp 21 by changing an on-duration or a drive frequency of a switching element Q1.

The control unit 32 includes a memory 32*a* for storing a predetermined power value and a stable power limiter 32*b* for calculating an output power target value by correcting the power value stored in the memory 32*a* depending on the surrounding environment. The surrounding environment referred to herein indicates an ambient temperature of the lighting device 3 and an actual DC power supply voltage. The ambient temperature of the lighting device 3 is detected by a temperature detector 32*c* arranged around the lighting device 3. The actual DC power supply voltage is detected by a power supply voltage detector 32*d* connected to a downstream side of a DC power supply switch SW1. The information acquired by the temperature detector 32*c* and the power supply voltage detector 32*d* is transmitted to the stable power limiter 32*b*. The stable power limiter 32*b* integrates the information and calculates an output power target value.

The control unit 32 includes a target current calculator 32*e* for deciding an output current target value by dividing the output power target value calculated in the stable power limiter 32*b* by an actually detected output power detection value. The control unit 32 also includes an error amplifier 32*f* for comparing the output current target value with an actual output current detection value. The control unit 32 sends an output control signal to the DC-DC converter 31*a* to reduce a difference between the output current target value and the output current detection value.

Description will now be made on the operation of the circuit configured as above. If the DC power source is turned on by the switch SW1 and if the switch Q1 is turned on, an electric current is allowed to flow through the primary side P1 of a transformer T1 and the switch Q1. Since a diode D1 is arranged in the secondary side S1 of the transformer T1, no electric current flows through the secondary side S1 and energy is accumulated in the transformer T1.

Next, if the switch Q1 is turned off, the electric current flows through a route of the secondary side S1 of the transformer T1, a smoothening capacitor C2 and the diode D1, so that the energy accumulated in the transformer T1 is moved to the smoothening capacitor C2. The discharge lamp is kept opened before it is turned on. Therefore, the voltage of the capacitor C2 becomes higher. If the switches Q2 and Q5 of the inverter 31*b* are turned on and if the switches Q3 and Q4 are kept turned off, the voltage of a capacitor Cs making up the igniter 23 increases.

If the voltage of the capacitor Cs becomes equal to or higher than a specified voltage, the spark gap SG1 of the igniter 23 is broken down. A voltage is instantaneously applied to the primary side P2 of a transformer T2. A high voltage (of about several tens kV) equivalent to the instantaneously applied voltage multiplied by a winding ratio is applied to the secondary side S2 of the transformer T2. The discharge lamp 21 is broken down by the high voltage. At this moment, an electric current is allowed to flow from the DC-DC converter 31*a* to the discharge lamp 21. The discharge lamp 21 serves as an arc discharge lamp.

After the discharge lamp 21 is turned on, the inverter 31*b* is alternately operated at specified time intervals, during which time the output current target value and the output current detection value are compared by the error amplifier 32*f* in the same manner as stated above. The output of the DC-DC converter 31*a* is adjusted by an output control signal corresponding to the error amount. Thus, the discharge lamp 21 is stably turned on.

In recent years, an engine room tends to have a narrower space in keeping with the expansion of an inner space of a motor vehicle (an automobile) and the vehicle weight reduction for the improvement of mileage. For this reason, a lighting device for a vehicle headlight is arranged near an engine which generates a large amount of heat. As a consequence, the lighting device is often exposed to high temperatures. Accordingly, it is required that the lighting device can stably turn on a discharge lamp even under high temperature environments. With the circuit described above, the ambient temperature of the lighting device 3 is detected by the temperature detector 32*c*. The electric current supplied to the discharge lamp 21 is adjusted depending on the temperature thus detected. It is therefore possible to stably turn on the discharge lamp 21 even under a high temperature environment.

Figure 3:
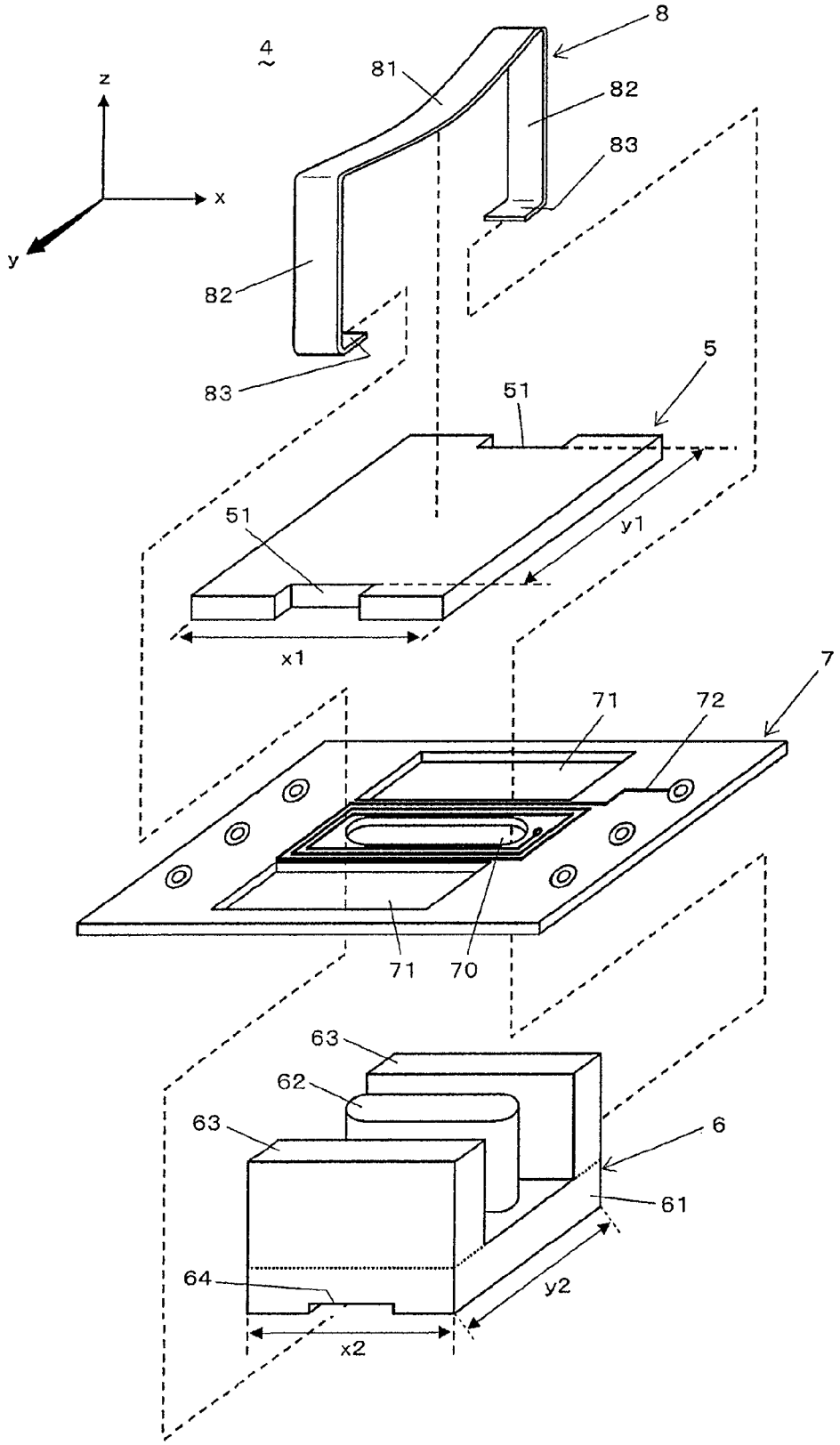
FIG. 3 is an exploded perspective view showing a power converting transformer making up the vehicle headlight.
Figure 4A:
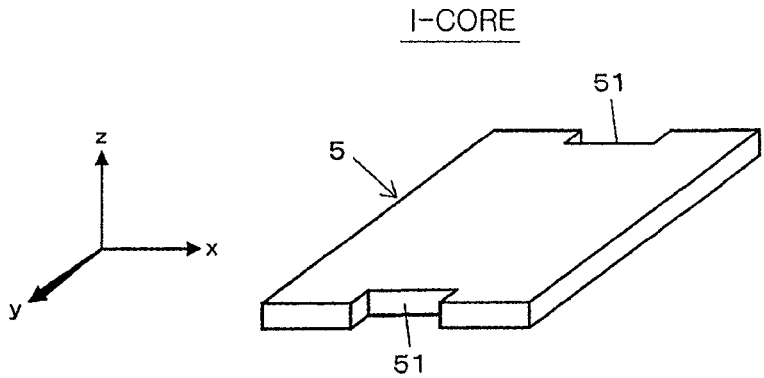
FIGS. 4A through 4E are views showing an I-core of the transformer seen in specific directions and FIGS. 4F through 4J are views showing an E-core of the transformer seen in specific directions.
Figure 4B:
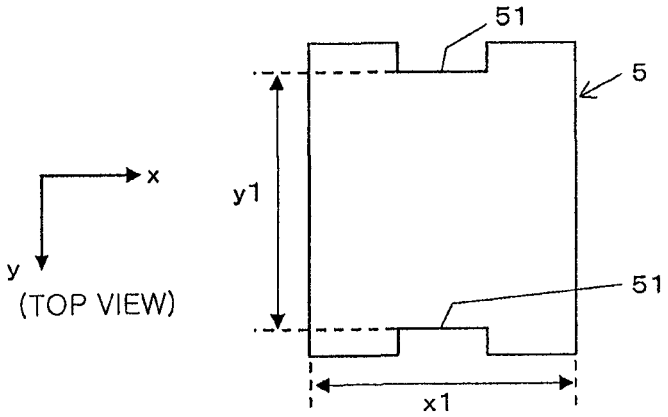
Figure 4C:
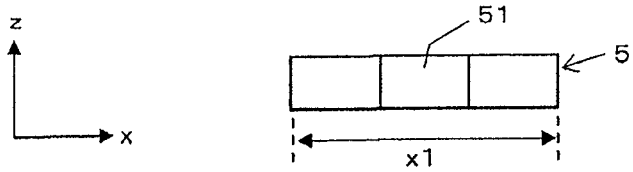
Figure 4D:
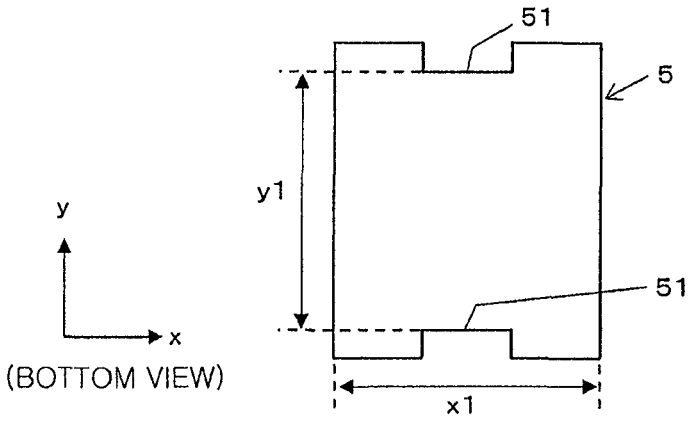
Figure 4E:
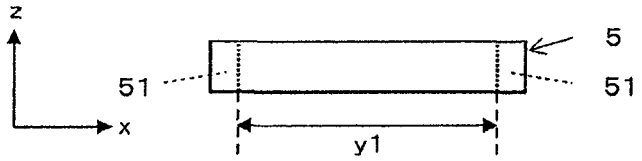
Figure 4F:
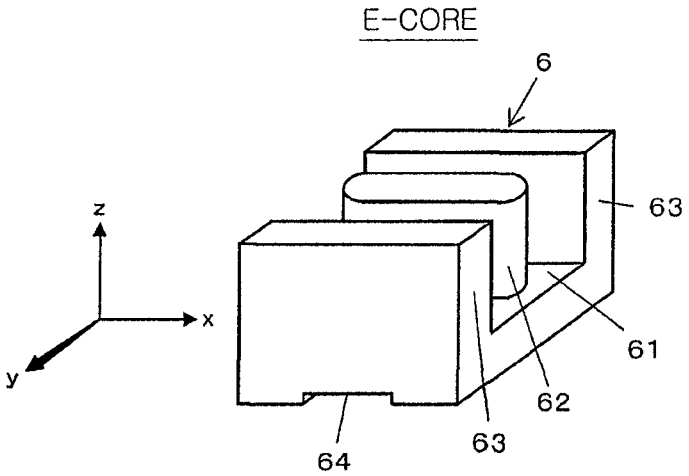
Figure 4G:
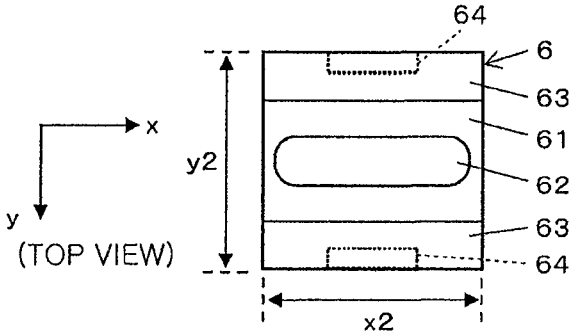
Figure 4H:
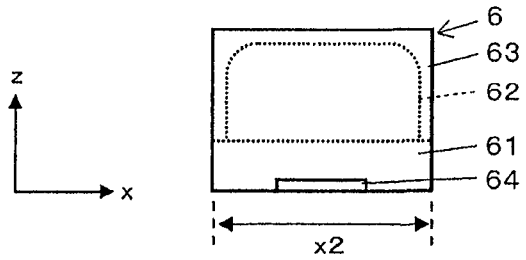
Figure 4I:
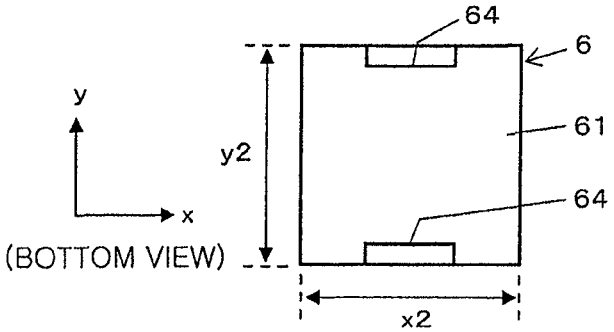
Figure 4J:
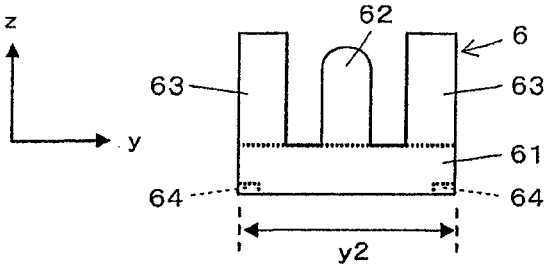

Next, a description will be made on the configurations of the transformers T1 and T2 employed in the aforementioned circuit. In the following description, the transformers T1 and T2 will be collectively referred to as "transformer 4". Directions will be defined through the use of a xyz orthogonal coordinate system. As shown in FIG. 3, the transformer 4 includes an I-core 5, an E-core 6 arranged in a facing relationship with the I-core 5, a printed wiring board 7 interposed between the I-core 5 and the E-core 6 and a fixing spring 8 for pressing and fixing the I-core 5 and the E-core 6 to each other with the printed wiring board 7 interposed therebetween. The direction extending toward the right side in FIG. 3 will be referred to as "x-direction". The direction extending toward the left and lower side in FIG. 3 will be referred to as "y-direction". The direction extending toward the upper side in FIG. 3 will be referred to as "z-direction". These x, y and z-directions are orthogonal to one another. The detailed structure of the I-core 5 is shown in FIGS. 4A through 4E. The detailed structure of the E-core 6 is illustrated in FIGS. 4F through 4J.

The I-core 5 is formed into a substantially rectangular flat plate shape to extend along an x-y plane. The I-core 5 includes a pair of fixing grooves 51 formed at the centers on the opposite side surfaces of the I-core 5 in the y-direction. The fixing grooves 51 extend through the I-core 5 in the z-direction. As will be described later, arm portions 82 of the fixing spring 8 are fitted into the respective fixing grooves 51. The x-direction length of the I-core 5 is assumed to be x1. The y-direction distance between the fixing grooves 51 of the I-core 5 is assumed to be y1. The I-core 5 is made of, e.g., ferrite obtained by mixing manganese oxide, zinc oxide or nickel oxide with iron oxide and then sintering the mixture at a temperature of about 1000 to 1400° C. More specifically, the I-core 5 is made of PC44, a product of TDK Corporation. The constituent material of the I-core 5 is appropriately selected such that the drive frequency of the transformer 4 becomes equal to 10 to 500 kHz.

The E-core 6 includes a substantially rectangular flat base portion 61 extending along the x-y plane, a central leg portion 62 installed upright at the center of the base portion 61 to extend in the z-direction and a pair of outer leg portions 63 installed upright at opposite end portions of the base portion 61 in the y-direction to extend in the z-direction. The I-core 5 is placed on the upper surfaces of the outer leg portions 63. The E-core 6 further includes a pair of fixing recess portions 64 formed at the x-direction centers of the y-direction opposite end portions of the E-core 6 on the surface of the base portion 61 opposite from the surface facing the I-core 5. As will be set forth later, engaging portions 83 of the fixing spring 8 are brought into engagement with the respective fixing recess portions 64. The x-direction length x2 of the E-core 6 is shorter than the x-direction length x1 of the I-core 5. The y-direction length y2 of the E-core 6 is shorter than the y-direction distance y1 between the fixing grooves 51 of the I-core 5. The E-core 6 is made of the same material as the I-core 5.

The wiring board 7 includes a central hole 70 through which the central leg portion 62 of the E-core 6 passes, a pair of lateral holes 71 through which the outer leg portions 63 of the E-core 6 pass, and a coil pattern 72 formed in the regions existing between the central hole 70 and the lateral holes 71. In the illustrated example, the coil pattern 72 is formed into a rectangular spiral shape. The thickness and width of the coil pattern 72 are appropriately decided depending on the required intensity of an electric current.

The fixing spring 8 is formed of a leaf spring having a substantially M-like shape when seen in the x-direction. The fixing spring 8 includes a pressing portion 81 bulging toward the surface (upper surface) of the I-core 5 opposite from the surface of the I-core 5 facing the E-core 6. The pressing portion 81 comes into contact with the upper surface of the I-core 5 and presses the I-core 5 against the E-core 6. The fixing spring 8 includes a pair of arm portions 82 extending from the opposite ends of the pressing portion 81 in the direction substantially orthogonal to the pressing portion 81 and a pair of engaging portions 83 bent from the ends of the arm portions 82 in a direction substantially orthogonal to the arm portions 82 to face each other. The arm portions 82 are fitted into the fixing grooves 51 of the I-core 5, thereby restraining the fixing spring 8 from getting out of alignment with the I-core 5 in the x-direction. The engaging portions 83 come into engagement with the fixing recess portions 64 of the E-core 6, thus holding the E-core 6 in place. The fixing spring 8 is made of, e.g., stainless steel (SUS).

Description will now be made on a sequence of assembling the transformer 4 configured as above. First, the wiring board 7 is placed on the base portion 61 of the E-core 6 in a state where the central leg portion 62 and the outer leg portions 63 of the E-core 6 pass through the central hole 70 and the lateral holes 71 of the wiring board 7. Thereafter, the I-core 5 is placed on the outer leg portions 63 of the E-core 6. Then, a force is applied to the regions of the arm portions 82 of the fixing spring 8 near the pressing portion 81, thereby deforming the fixing spring 8 so that the engaging portions 83 are moved away from each other. In this state, the fixing spring 8 is caused to come close to the I-core 5 from above and the engaging portions 83 pass through the lateral holes 71 of the wiring board 7. Then, the fixing spring 8 is pushed downward until the engaging portions 83 are positioned at the lateral sides of the fixing recess portions 64 of the E-core 6. In this state, the force applied to the arm portions 82 of the fixing spring 8 is relieved to thereby bring the engaging portions 83 into engagement with the fixing recess portions 64. Consequently, the I-core 5 and the E-core 6 are kept unified by the fixing spring 8. The I-core 5 is pressed against the E-core 6 by the pressing portion 81 of the fixing spring 8. As a result, the I-core 5 and the E-core 6 are pressed and fixed to each other.

Figure 5A:
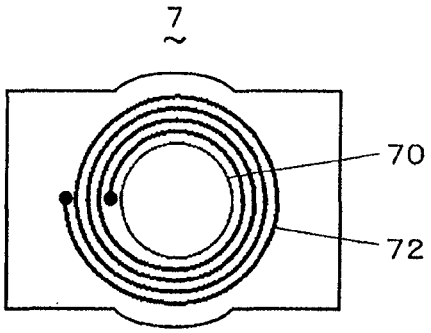
FIGS. 5A and 5B are views showing different modified examples of a printed wiring board making up the transformer.
Figure 5B:
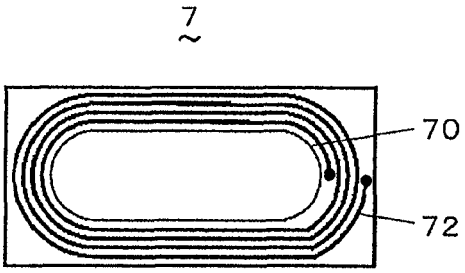

The coil pattern 72 of the wiring board 7 is not limited to the shape shown in FIG. 3. For example, as shown in FIG. 5A, the coil pattern 72 may be formed into a circular spiral shape around a circular central hole 70. As depicted in FIG. 5B, the coil pattern 72 may be formed into a substantially elliptical spiral shape around a substantially elliptical central hole 70.

Figure 6:
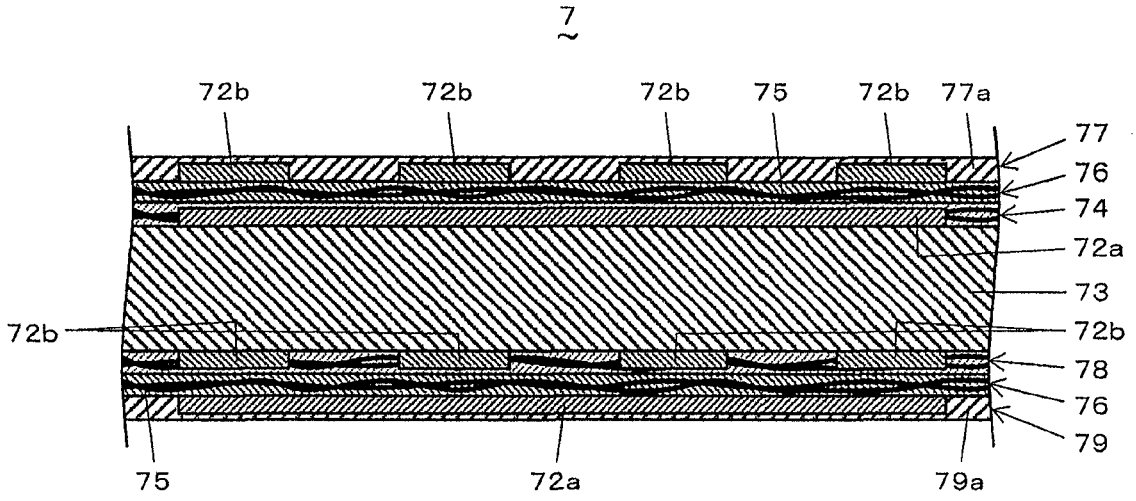
FIG. 6 is a side section view of the printed wiring board.

As shown in FIG. 6, the wiring board 7 is formed of, e.g., a four-layer board. In this case, the wiring board 7 includes a flat core substrate 73, a layer 74 formed on the upper surface of the core substrate 73 and provided with a primary coil 72*a*, a layer 76 formed on the layer 74 and provided with a prepreg 75, and a layer 77 formed on the layer 76 and provided with a secondary coil 72*b*. The wiring board 7 further includes a layer 78 formed on the lower surface of the core substrate 73 and provided with a secondary coil 72*b*, a layer 76 formed below the layer 78 and provided with a prepreg 75, and a layer 79 formed below the layer 76 and provided with a primary coil 72*a*. The secondary coil 72*b* of the layer 77 and the primary coil 72*a* of the layer 79 are respectively coated with resists 77*a* and 79*a*. The prepreg 75 is also added to the layer 74 and the layer 78. The core substrate 73 of the wiring board 7 is made of, e.g., a glass epoxy resin such as FR-4 or the like. The prepreg 75 is made of, e.g., reticular glass fibers or reticular carbon fibers.

Figure 7:
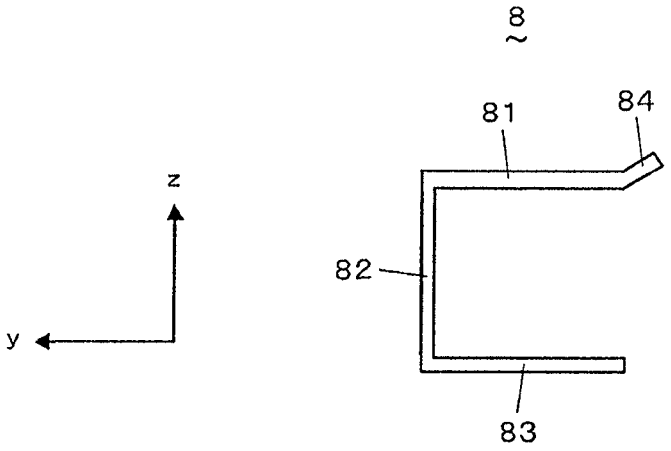
FIG. 7 is a view showing a modified example of a fixing spring making up the transformer.
Figure 8A:
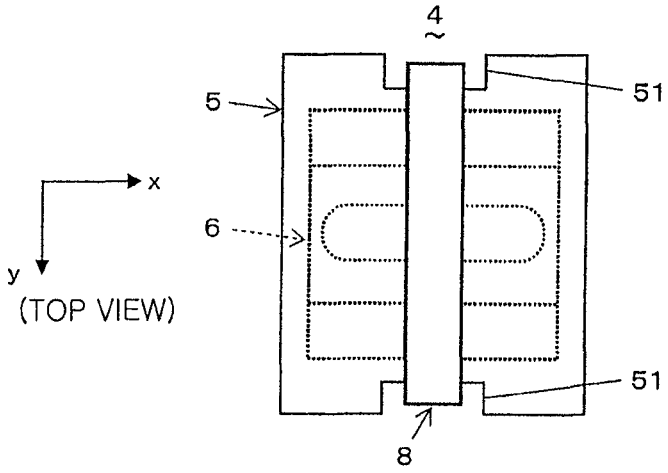
FIGS. 8A through 8D are views showing the transformer seen in specific directions.
Figure 8B:
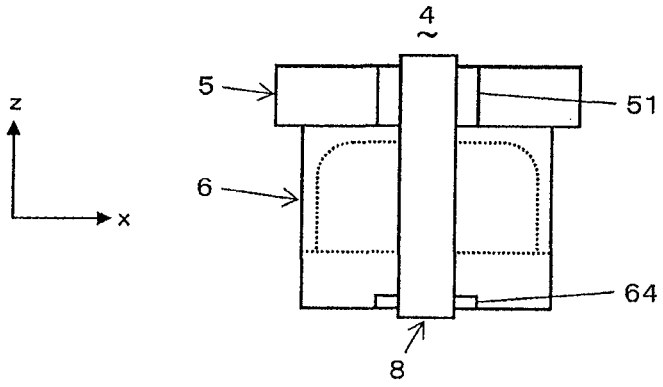
Figure 8C:
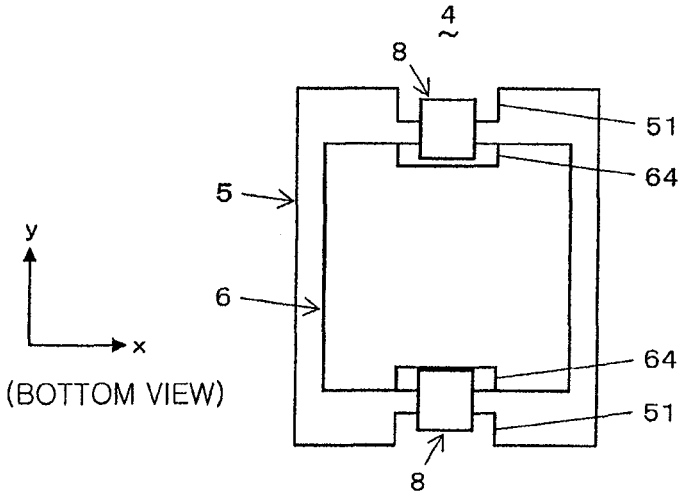
Figure 8D:
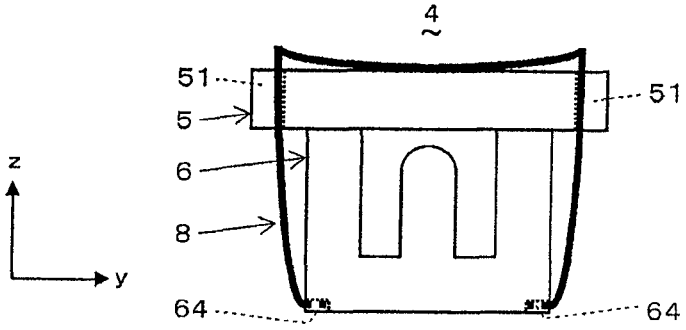

The fixing spring 8 is not limited to the shape shown in FIG. 3. For example, as shown in FIG. 7, the fixing spring 8 may be formed of a leaf spring having a substantially C-like shape when seen in the x-direction. In this case, the fixing spring 8 includes a pressing portion 81, an arm portion 82 extending from one end of the pressing portion 81 in a direction substantially orthogonal to the pressing portion 81, and an engaging portion 83 extending from one end of the arm portion 82 in a direction substantially orthogonal to the arm portion 82 so as to correspond to the pressing portion 81. The fixing spring 8 further includes a holding portion 84 provided at the other end of the pressing portion 81 and bent toward the opposite side from the side at which the engaging portion 83 exists. The holding portion 84 is used as a grip when attaching or detaching the fixing spring 8 to or from the I-core 5 and the E-core 6. The fixing spring 8 presses and fixes the I-core 5 and the E-core 6 to each other by having the pressing portion 81 press the upper surface of the I-core 5 and having the engaging portion 83 support the lower surface of the base portion 61 of the E-core 6. The fixing spring 8 is attached to the I-core 5 and the E-core 6 by gripping the holding portion 84, causing the engaging portion 83 to slide inward along the lower surface of the base portion 61 of the E-core 6, arranging the pressing portion 81 on the upper surface of the I-core 5, and then releasing the holding portion 84.

Figure 9A:
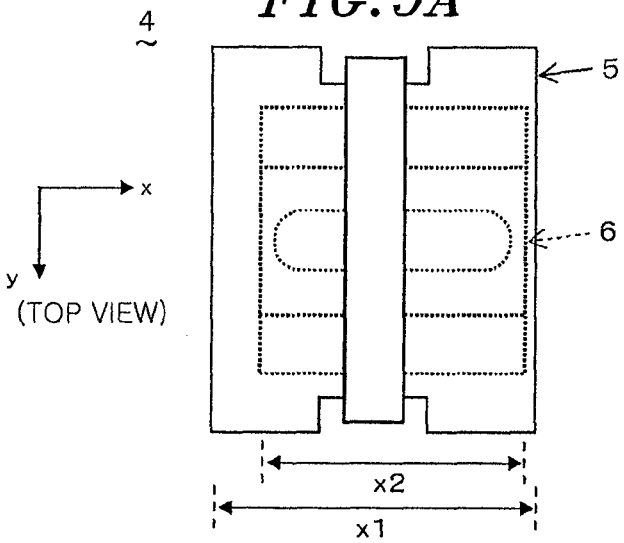
FIGS. 9A through 9C are views showing a state where the E-core is misaligned in an x-direction with respect to the I-core in the transformer.
Figure 9B:
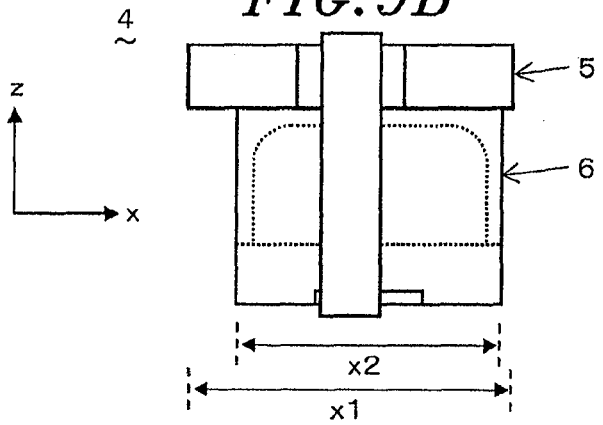
Figure 9C:
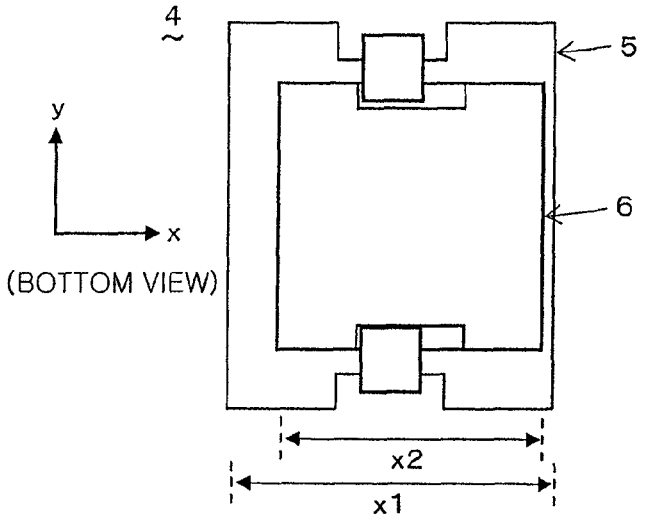
Figure 10A:
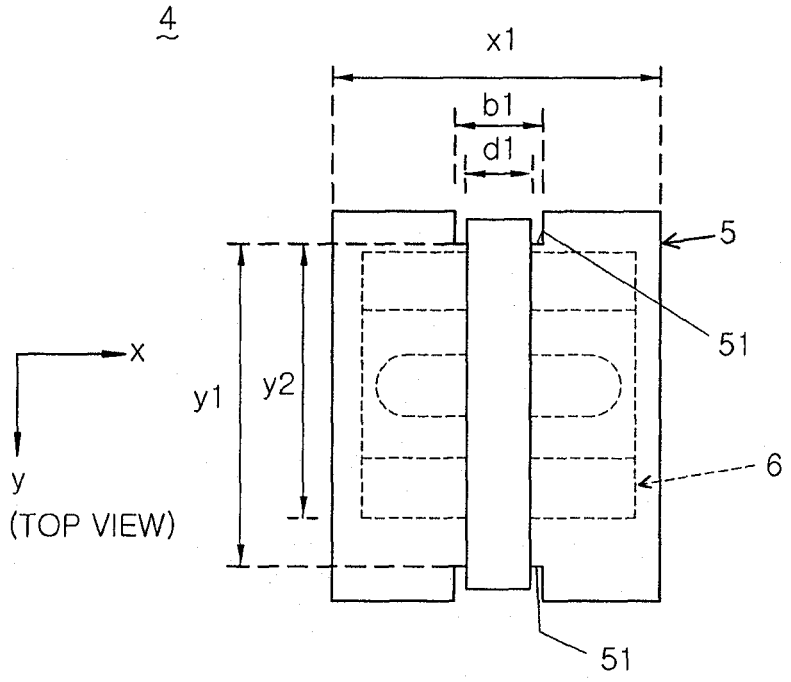
FIGS. 10A through 10C are views showing a state where the E-core is misaligned in a y-direction with respect to the I-core in the transformer.
Figure 10B:
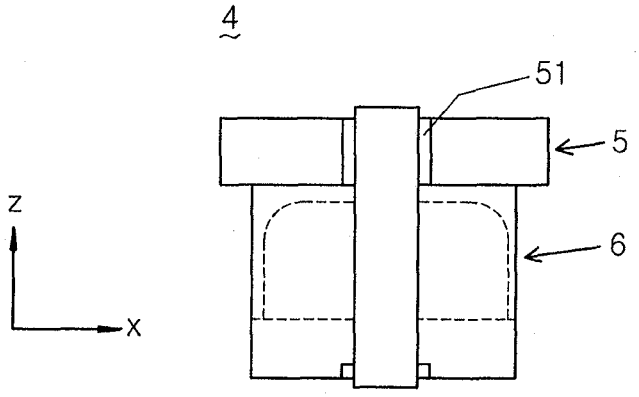
Figure 10C:
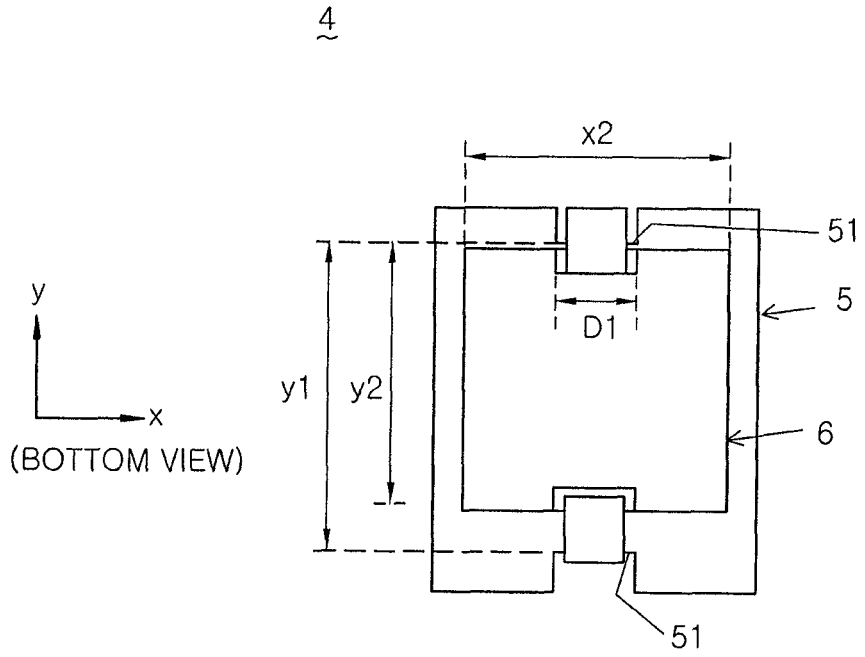

As shown in FIGS. 8A through 8D, the I-core 5 and the E-core 6 are pressed and fixed to each other by the fixing spring 8 wrapped around the I-core 5 and the E-core 6 through the fixing grooves 51 of the I-core 5 and the fixing recess portions 64 of the E-core 6. The x-direction length x1 of the I-core 5 is larger than the x-direction length x2 of the E-core 6. Therefore, even if the E-core 6 gets out of alignment with respect to the I-core 5 in the x-direction as shown in FIGS. 9A through 9C, the E-core 6 seldom protrudes beyond the I-core 5. Similarly, the distance y1 between the fixing grooves 51 of the I-core 5 is longer than the y-direction length y2 of the E-core 6. Therefore, even if the E-core 6 gets out of alignment with respect to the I-core 5 in the y-direction as shown in FIGS. 10A through 10C, the E-core 6 seldom protrudes beyond the I-core 5.

The x-direction length x1 of the I-core 5 is defined by the x-direction length x2 of the E-core 6, the x-direction length D1 of the fixing recess portions 64 of the E-core 6, the x-direction length b1 of the fixing grooves 51 of the I-core 5 and the x-direction width d1 of the fixing spring 8. More specifically, as represented by the following Equation 1, the length x1 of the I-core 5 is larger than or equal to the length x2 of the E-core 6 added by the length D1 of the fixing recess portions 64 and the length b1 of the fixing grooves 51 and subtracted by the double of the width d1 of the fixing spring 8.

$$x1 \geq x2+(D1+b1-2d1). \qquad \text{Equation 1}$$

Figure 11A:
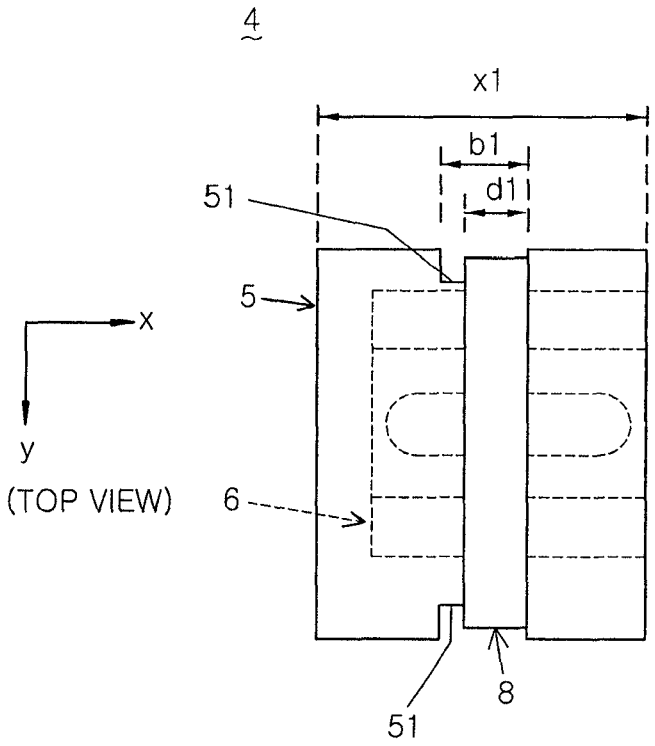
FIGS. 11A through 11C are views showing a case where the E-core is misaligned in an x-direction with respect to the I-core in the transformer and FIGS. 11D through 11F are views showing a case where the E-core is misaligned in a minus x-direction with respect to the I-core in the transformer.
Figure 11B:
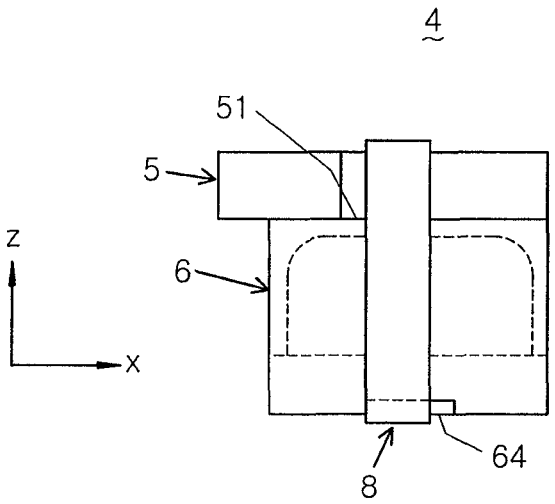
Figure 11C:
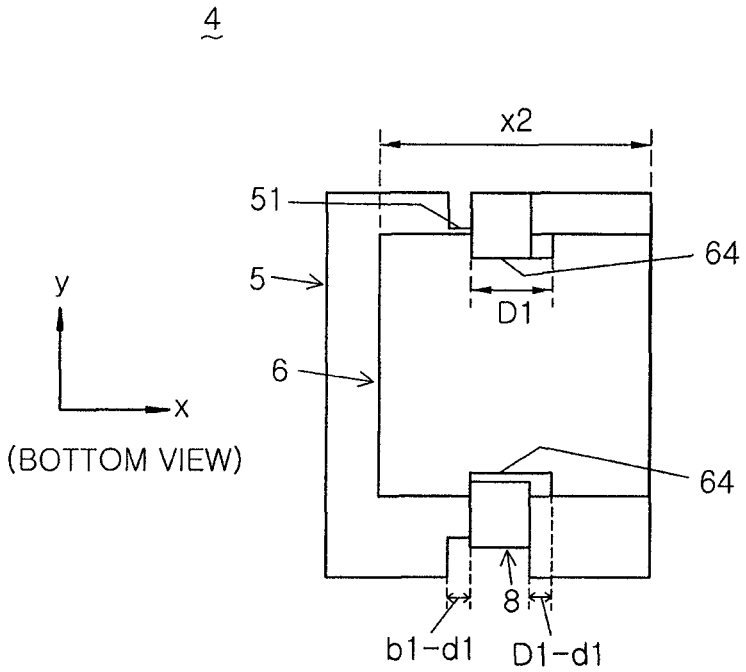
Figure 11D:
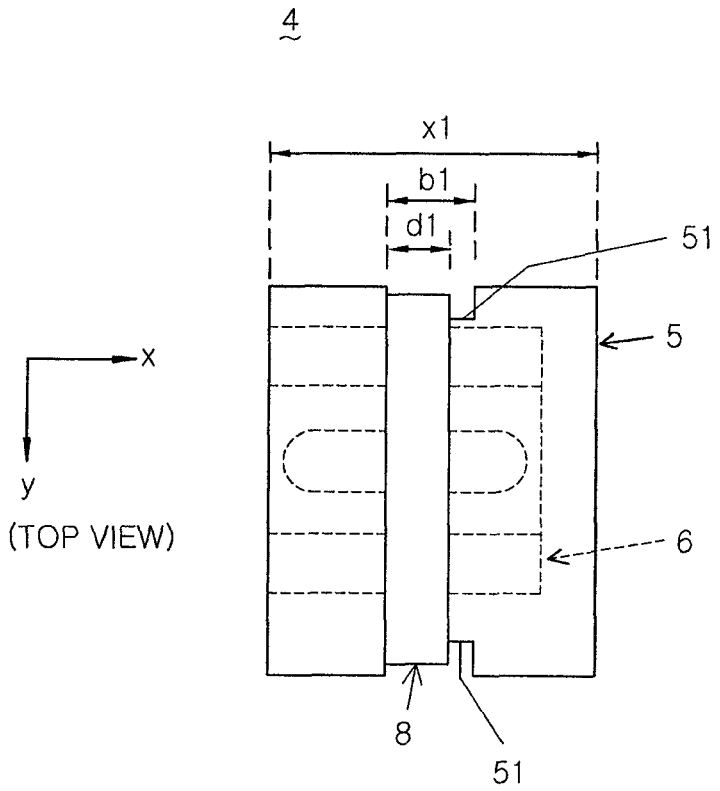
Figure 11E:
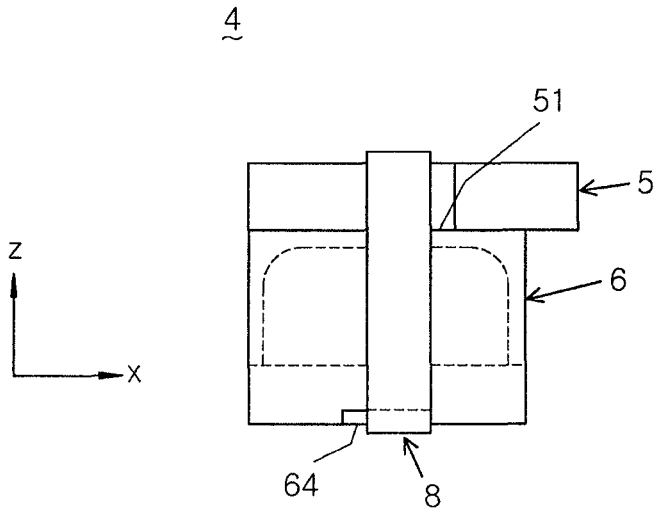
Figure 11F:
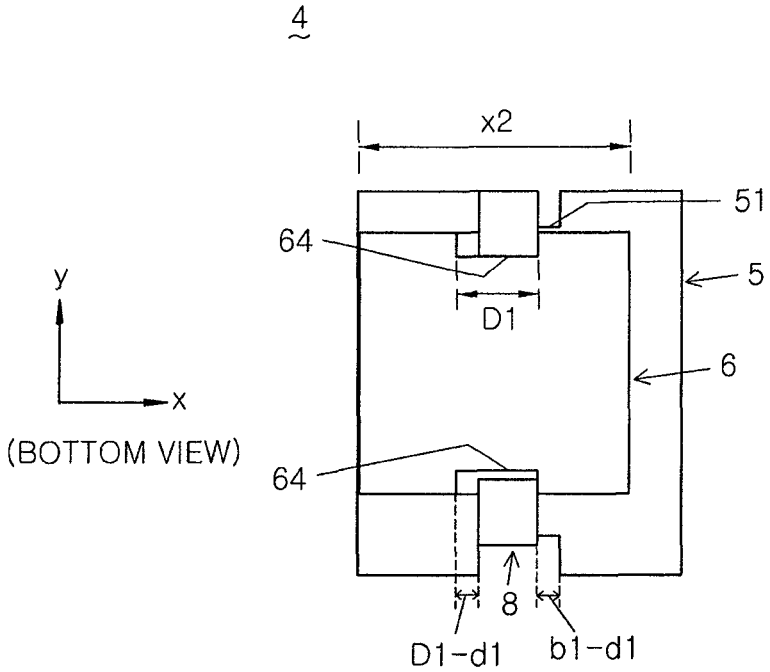
Figure 12A:
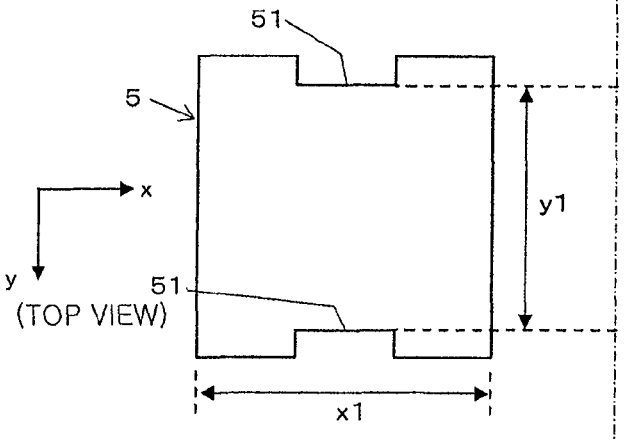
FIGS. 12A through 12C are views showing an I-core of a transformer according to a second embodiment seen in specific directions and FIGS. 12D through 12F are views showing an E-core of the transformer seen in specific directions.
Figure 12D:
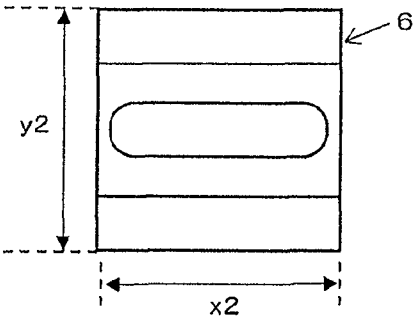
Figure 12B:
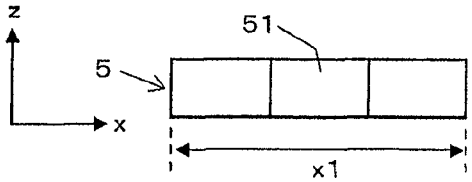
Figure 12E:
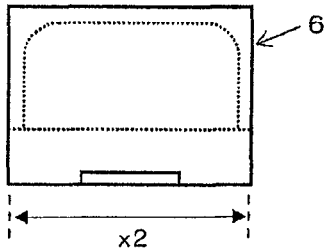
Figure 12C:
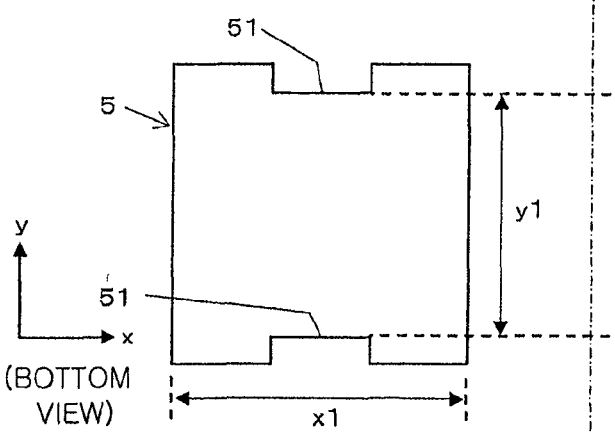
Figure 12F:
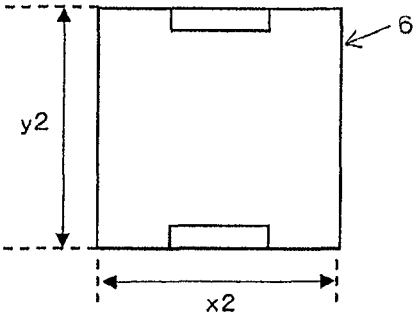
Figure 13A:
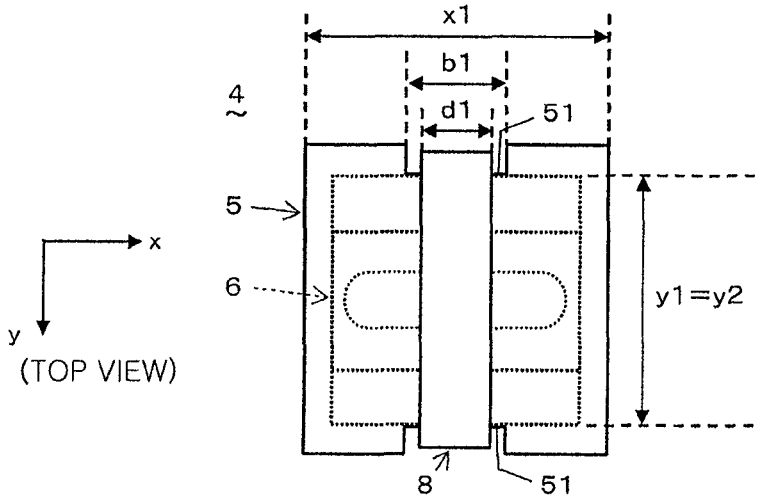
FIGS. 13A through 13D are views showing the transformer of the second embodiment seen in specific directions.
Figure 13B:
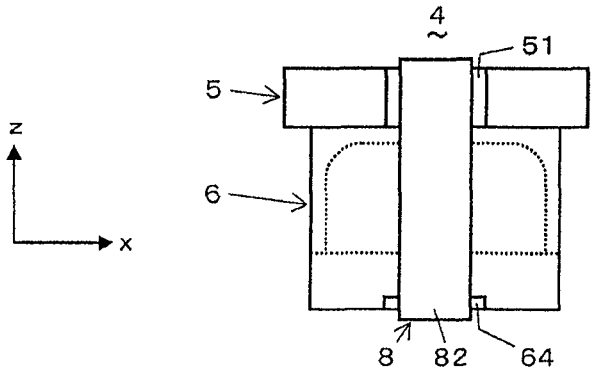
Figure 13C:
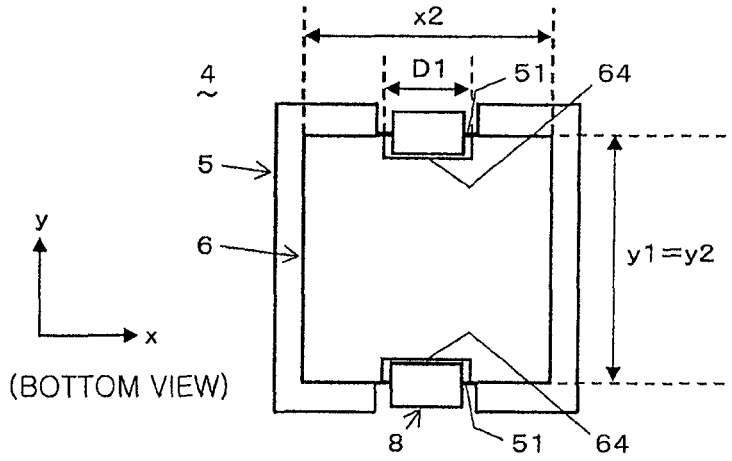
Figure 13D:
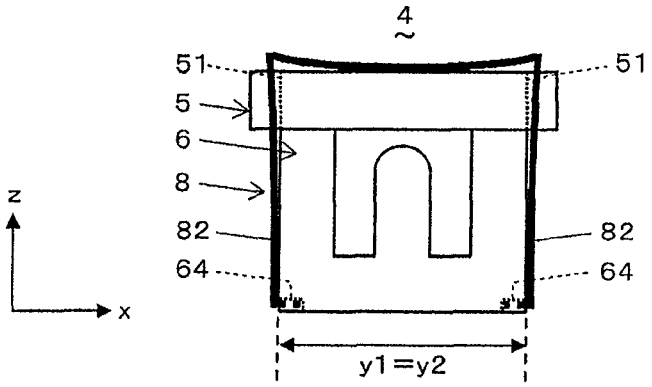
Figure 14A:
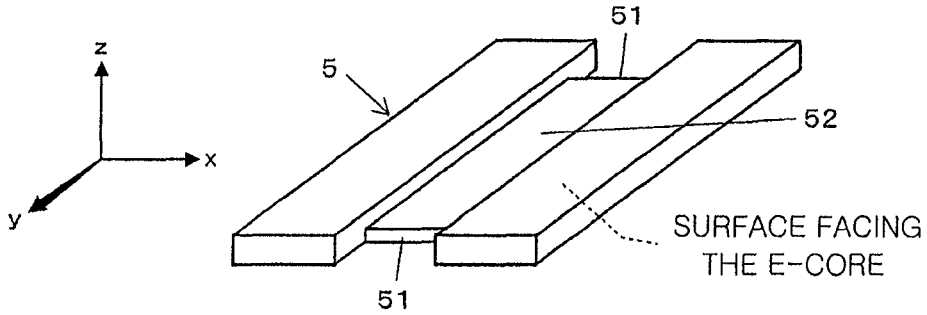
FIGS. 14A through 14D are views showing an I-core of a transformer according to a third embodiment seen in specific directions.
Figure 14B:
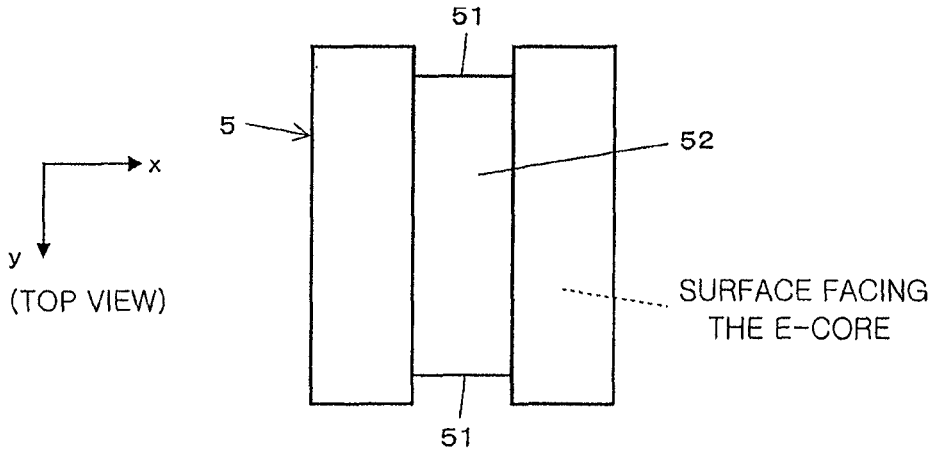
Figure 14C:
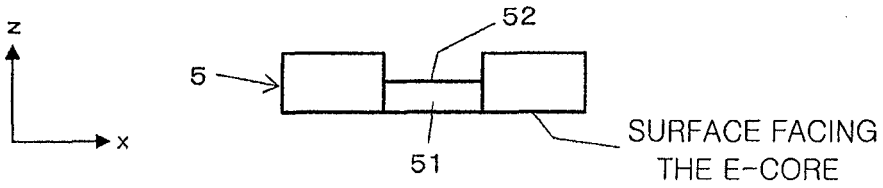
Figure 14D:
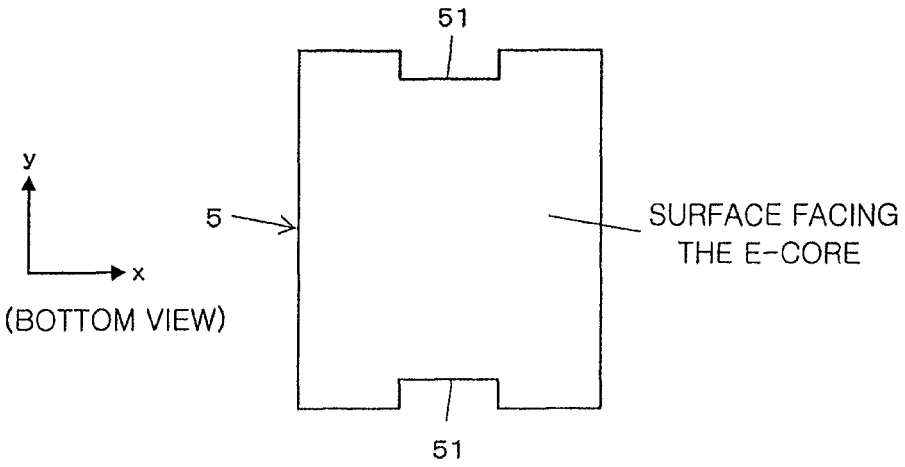

FIGS. 11A through 11C show a state where the E-core 6 is misaligned to the greatest extent in the x-direction with respect to the I-core 5. FIGS. 11D through 11F show a state that the E-core 6 is misaligned to the greatest extent in the minus x-direction with respect to the I-core 5. It is now assumed that the state shown in FIGS. 11A through 11C is shifted to the state shown in FIGS. 11D through 11F. At this time, the I-core 5 is moved by a distance (b1−d1) in the x-direction until the fixing spring 8 comes into contact with the minus x-direction ends of the fixing grooves 51. The E-core 6 is moved by a distance (D1−d1) in the minus x-direction until the x-direction ends of the fixing recess portions 64 come into contact with the fixing spring 8. In other words, the E-core 6 is displaced relative to the I-core 5 by a distance (b1−d1)+(D1−d1)=D1+b1−2d1 in the minus x-direction.

Accordingly, if x1 is set equal to x2+(D1+b1−2d1), one of the opposite side surfaces of the I-core 5 in the x-direction stays flush with the corresponding side surface of the E-core 6 in the x-direction even through the E-core 6 is misaligned to the greatest extent in the x-direction or in the minus x-direction with respect to the I-core 5. Moreover, if x1 is set smaller than x2+(D1+b1−2d1), the E-core 6 seldom protrudes beyond the I-core 5 even through the E-core 6 is misaligned to the greatest extent in the x-direction or in the minus x-direction with respect to the I-core 5.

With the transformer 4 of the present embodiment described above, the I-core 5 and the E-core 6 are pressed and fixed to each other by the fixing spring 8. For this reason, the E-core 6 seldom gets out of alignment with respect to the I-core 5. Assuming that the E-core 6 is slightly misaligned with respect to the I-core 5, the E-core 6 seldom protrudes beyond the I-core 5. This is because the I-core 5 is larger in size than the E-core 6. For this reason, it is possible to suppress leakage of magnetic fluxes attributable to the misalignment between the I-core 5 and the E-core 6. Accordingly, it becomes possible to reduce a change in the electric characteristics of the transformer and a power loss in the circuit, thereby enhancing the power converting efficiency and reliability of the transformer 4. As a result, it is possible to stably energize the vehicle headlight 1.

Next, a transformer according to a second embodiment of the present invention will be described with reference to FIGS. 12A to 13D. In the present embodiment, as shown in FIGS. 12A through 12F, the distance y1 between the fixing grooves 51 of the I-core 5 is equal to the y-direction length y2 of the E-core 6. On the other hand, the x-direction length X1 of the I-core 5 is larger than the x-direction length x2 of the E-core 6.

In case where the I-core 5 and the E-core 6 are pressed and fixed to each other by the fixing spring 8 as shown in FIGS. 13A through 13D, the bottom surfaces of the fixing grooves 51 of the I-core 5 are respectively flush with the opposite side surfaces of the E-core 6 in the y-direction. This is because y1 is set equal to y2. In this regard, the fixing spring 8 is configured such that the arm portions 82 thereof make close contact with the fixing grooves 51 of the I-core 5 and the opposite side surfaces of the E-core 6 in the y-direction (see FIG. 13D).

Similar to the first embodiment, the x-direction length x1 of the I-core 5 is defined by the x-direction length x2 of the E-core 6, the x-direction length D1 of the fixing recess portions 64 of the E-core 6, the x-direction length b1 of the fixing grooves 51 of the I-core 5 and the x-direction width d1 of the fixing spring 8 to satisfy the aforementioned Equation 1.

With the transformer of the present embodiment described above, the bottom surfaces of the fixing grooves 51 of the I-core 5 are respectively flush with the opposite side surfaces of the E-core 6 in the y-direction. In addition, the arm portions 82 of the fixing spring 8 make close contact with the fixing grooves 51 of the I-core 5 and the y-direction lateral surfaces of the E-core 6. For this reason, the I-core 5 and the E-core 6 can be more strongly pressed and fixed to each other by the fixing spring 8 than when a gap exists between the arm portions 82 and the E-core 6. Even if the E-core 6 is misaligned to a greatest extent in the x-direction or in the minus x-direction with respect to the I-core 5, the E-core 6 does not protrude beyond the I-core 5. It is therefore possible to reliably prevent leakage of magnetic fluxes attributable to the misalignment between the I-core 5 and the E-core 6.

Figure 15:
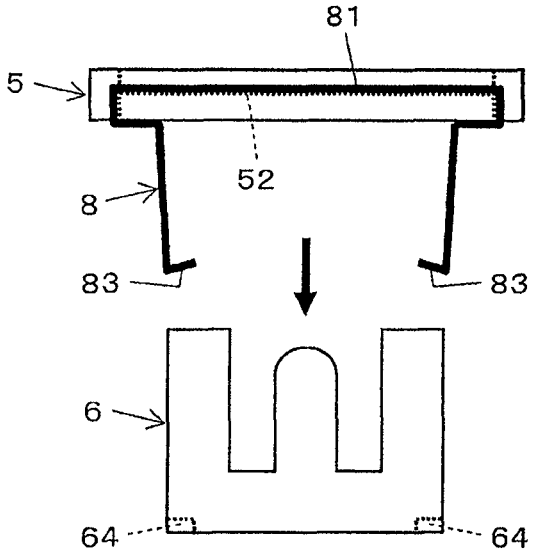
FIG. 15 is a view illustrating an operation in which the I-core and the E-core are fixed to each other by a fixing spring in the transformer provided with the I-core in accordance with the third embodiment.
Figure 16A:
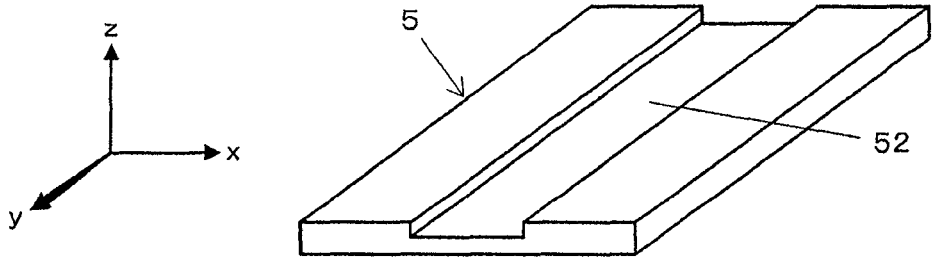
FIGS. 16A through 16D are views showing an I-core of a transformer according to a modification of the third embodiment seen in specific directions.
Figure 16B:
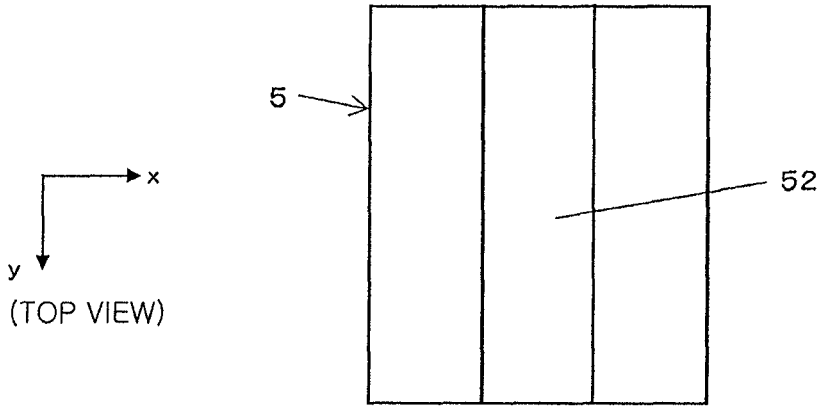
Figure 16C:
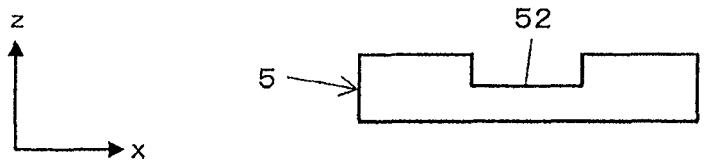
Figure 16D:
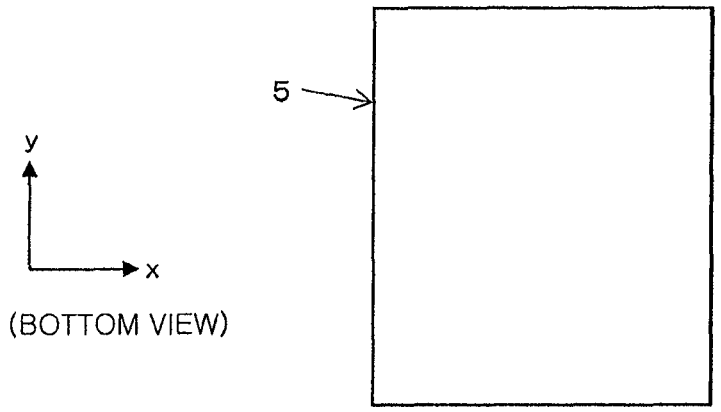

Next, a transformer according to a further embodiment of the present invention will be described with reference to FIGS. 14 and 15. As shown in FIG. 14, the I-core 5 of the present embodiment includes a fit-in groove 52 formed on the surface (upper surface) of the I-core 5 opposite from the surface of the I-core 5 facing the E-core 6. The fit-in groove 52 extends in the y-direction so as to interconnect the fixing grooves 51. As shown in FIG. 15, the pressing portion 81 of the fixing spring 8 is fitted into the fit-in groove 52, whereby the fixing spring 8 is tentatively fixed to the I-core 5. In order to join the I-core 5 and the E-core 6 together, the I-core 5 and the E-core 6 are caused to face each other by holding the I-core 5 to which the fixing spring 8 is tentatively fixed. In this state, the I-core 5 is moved toward the E-core 6 until the engaging portions 83 of the fixing spring 8 come into engagement with the fixing recess portions 64 of the E-core 6.

With the transformer of the present embodiment described above, the fixing spring 8 can be tentatively fixed to the I-core 5. This makes it easy to join the I-core 5 and the E-core 6 together, thereby enhancing the ease of assembly of the transformer.

Next, an I-core 5 making up a transformer according to a reference example of the aforementioned embodiments will be described with reference to FIG. 16. The I-core 5 of the present reference example differs from the I-core 5 of the foregoing embodiments in that the I-core 5 does not include the fixing grooves 51. Use of this type of I-core 5 can also provide the same effects as provided by the foregoing embodiments.

Figure 17A:
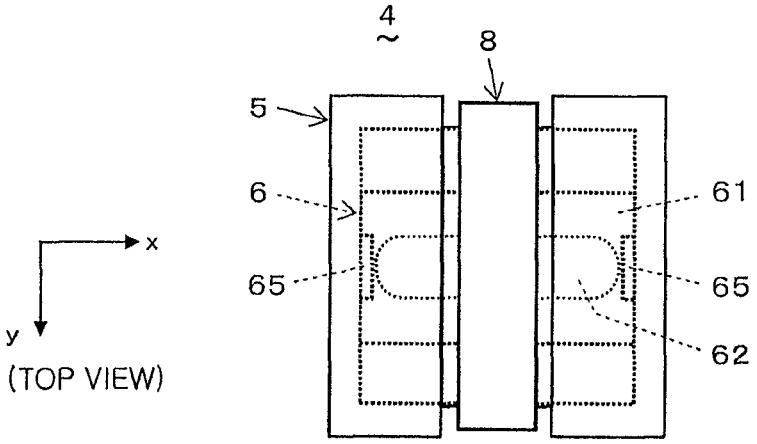
FIGS. 17A through 17C are views showing a transformer according to a fourth embodiment seen in specific directions.
Figure 17B:
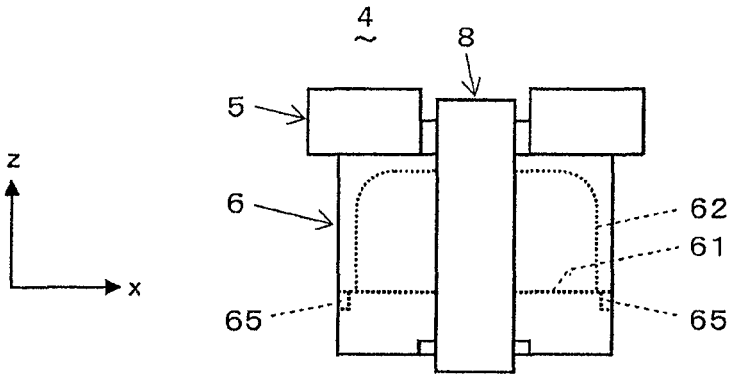
Figure 17C:
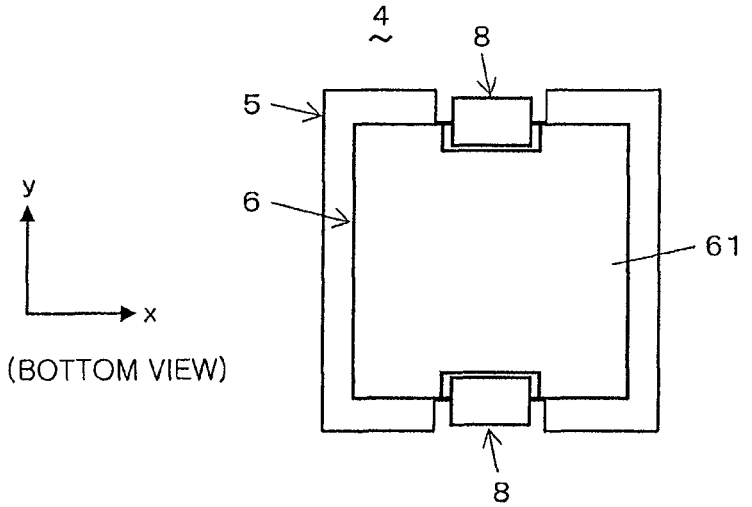

Next, a transformer according to a still further embodiment of the present invention will be described with reference to FIGS. 17 through 19. As shown in FIG. 17, the E-core 6 of the present embodiment includes anti-short-circuit grooves 65 provided in the base portion 61 near the circumferential edge of the central leg portion 62 so as to prevent the E-core 6 from being short-circuited with the coil pattern 72 of the wiring board 7. The anti-short-circuit grooves 65 are engraved on the surface of the base portion 61 on which the central leg portion 62 is installed upright. The anti-short-circuit grooves 65 are provided in the positions corresponding to the intermediate via-portion 80 of the wiring board 7 to be described later. While two anti-short-circuit grooves 65 are provided in the illustrated example, it is only necessary to provide at least one anti-short-circuit groove.

Figure 18:
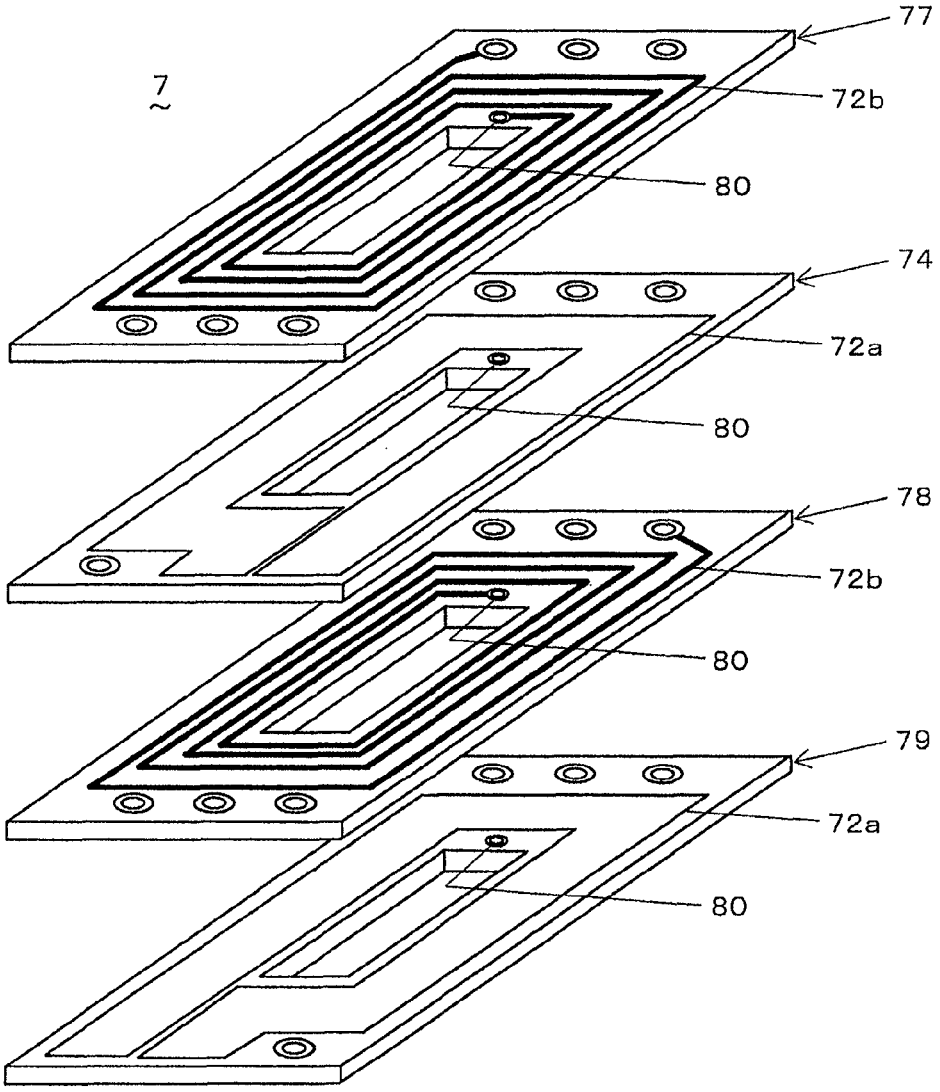
FIG. 18 is an exploded perspective view showing a multi-layer printed wiring board gripped by the transformer.

As shown in FIG. 18, it is assumed that the wiring board 7 includes four layers, e.g., a layer 77 having a secondary wiring line 72*b*, a layer 74 having a primary wiring line 72*a*, a layer 78 having a secondary wiring line 72*b*, and a layer 79 having a primary wiring line 72*a*, which layers are arranged in the named order from above. In this case, the wiring lines 72*a* and 72*b* of the respective layers are electrically connected to one another through an intermediate via-portion 80.

Figure 19:
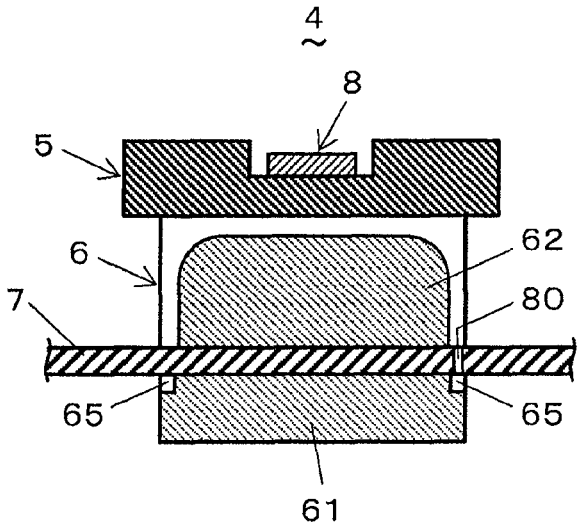
FIG. 19 is a side section view of the transformer gripping the multi-layer printed wiring board.

As shown in FIG. 19, if the wiring board 7 having the intermediate via-portion 80 is gripped by the I-core 5 and the E-core 6, one of the anti-short-circuit grooves 65 is arranged below the intermediate via-portion 80. Thus, the intermediate via-portion 80 and the E-core 6, all of which are electrically conductive, do not make direct contact with each other. The isolation distance between the intermediate via-portion 80 and one of the anti-short-circuit grooves 65 is preferably set equal to about 1 mm per kV.

With the transformer of the present embodiment described above, the intermediate via-portion 80 of the wiring board 7 does not make direct contact with the E-core 6. Therefore, even if a spacer made of an electrically insulating material is not provided between the intermediate via-portion 80 and the E-core 6, it is possible to electrically isolate the wiring board 7 and the E-core 6 from each other.

Figure 20A:
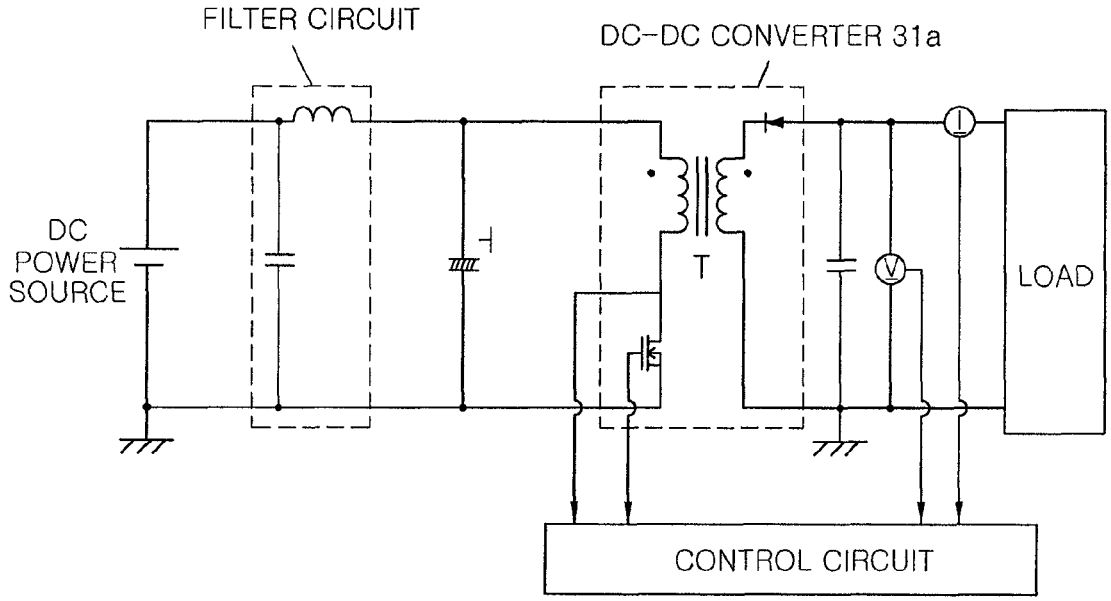
FIGS. 20A and 20B are circuit diagrams each showing a circuit formed through the use of the transformer according to the present invention.
Figure 20B:
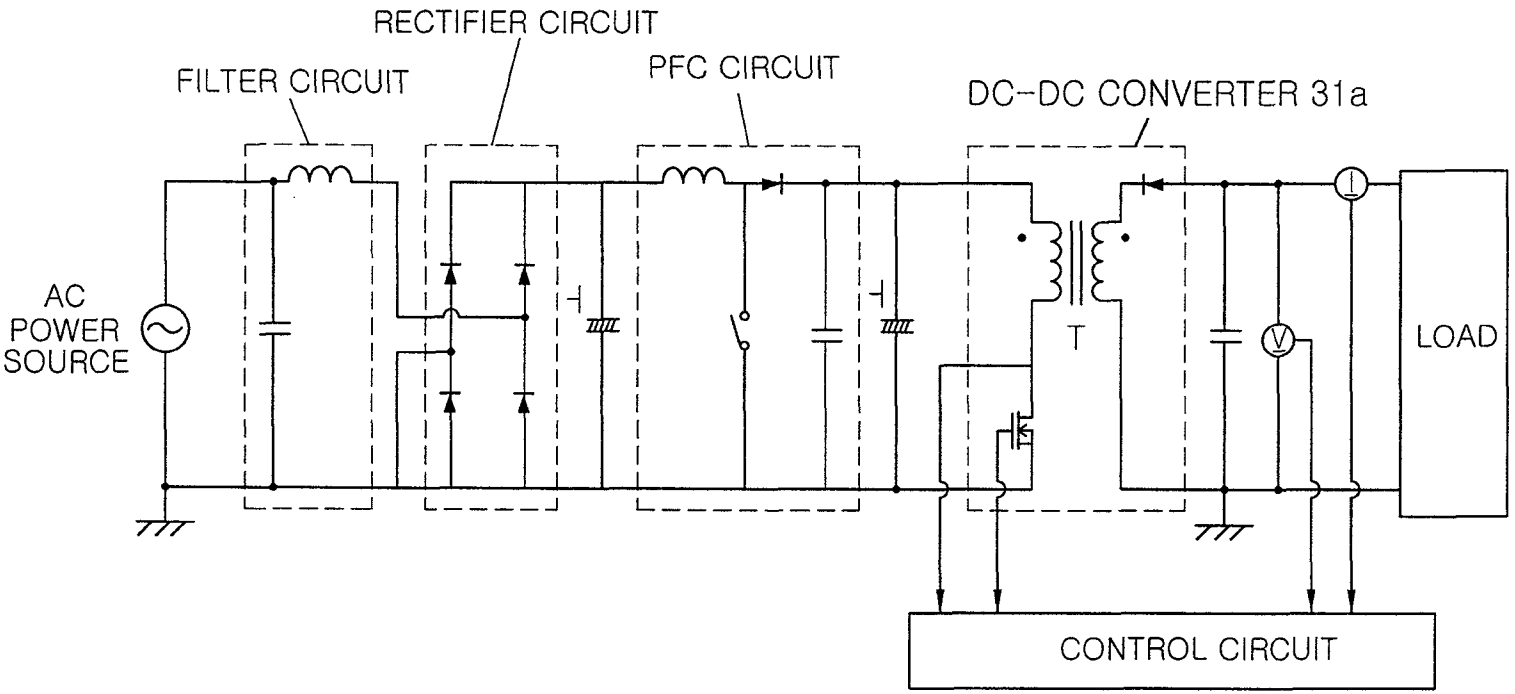

The present transformer described above is not limited to the use in the circuit shown in FIG. 2. For example, as shown in FIGS. 20A and 20B, the present transformer may be used as a transformer for the fly-back type DC-DC converter 31*a* making up various kinds of circuits.

The motor vehicle according to the present invention, the vehicle headlight mounted to the motor vehicle, and the power converting transformer making up the vehicle headlight are not limited to the embodiments described above but may be modified in many different forms. For example, the coil of the transformer is not limited to the pattern formed on the printed wiring board and may be formed by winding a copper wire around a bobbin. Likewise, the light source of the vehicle headlight is not limited to the discharge lamp and may be formed of other light sources, e.g., an LED.

While the invention has been shown and described with respect to the embodiments, it will be understood by those skilled in the art that various changes and modification may be made without departing from the scope of the invention as defined in the following claims.

What is claimed is:

1. A power converting transformer, comprising:

a substantially rectangular flat I-core extending along an x-y plane in an xyz orthogonal coordinate system; and an E-core including a substantially rectangular flat base portion extending along the x-y plane, a central leg portion installed upright at a center of the base portion to extend in a z-direction, and a pair of outer leg portions installed upright in opposite end portions of the base portion in a y-direction to extend in the z-direction, the I-core placed on the outer leg portions, wherein the I-core includes a pair of fixing grooves provided at centers on opposite side surfaces of the I-core in the y-direction, the fixing grooves extending through the I-core in the z-direction, the E-core includes a pair of fixing recess portions provided on a surface of the base portion opposite from a surface of the base portion facing the I-core, the pair of fixing recess portions provided at centers in the x-direction of the opposite end portions of the base portion, the I-core and the E-core are pressed and fixed to each other by a fixing spring wrapped around the I-core and the E-core through the fixing grooves and the fixing recess portions, and an x-direction length of the E-core is shorter than an x-direction length of the I-core, a y-direction length of the E-core being shorter than or equal to a y-direction distance between the fixing grooves of the I-core.

2. The power converting transformer of claim 1, wherein the y-direction distance between the fixing grooves of the I-core is equal to the y-direction length of the E-core.

3. The power converting transformer of claim 1, wherein the x-direction length of the I-core is defined by an x-direction length of the E-core, an x-direction length of the fixing recess portions of the E-core, an x-direction length of the fixing grooves of the I-core and an x-direction width of the fixing spring.

4. The power converting transformer of claim 2, wherein the x-direction length of the I-core is defined by an x-direction length of the E-core, an x-direction length of the fixing recess portions of the E-core, an x-direction length of the fixing grooves of the I-core and an x-direction width of the fixing spring.

5. The power converting transformer of claim 3, wherein the x-direction length of the I-core is larger than or equal to the x-direction length of the E-core added by the x-direction length of the fixing recess portions of the E-core and the x-direction length of the fixing grooves of the I-core and subtracted by the double of the x-direction width of the fixing spring.

6. The power converting transformer of claim 4, wherein the x-direction length of the I-core is larger than or equal to the x-direction length of the E-core added by the x-direction length of the fixing recess portions of the E-core and the x-direction length of the fixing grooves of the I-core and subtracted by the double of the x-direction width of the fixing spring.

7. The power converting transformer of claim 1, wherein the I-core includes a fit-in groove into which the fixing spring is fitted, the fit-in groove formed on a surface of the I-core opposite from a surface of the I-core facing the E-core, the fit-in groove extending in the y-direction to interconnect the fixing grooves.

8. The power converting transformer of claim 1, wherein the E-core includes an anti-short-circuit groove provided in the base portion near a circumferential edge of the central leg portion to prevent the E-core from being short-circuited with a coil pattern of a wiring board interposed between the I-core and the E-core.

9. A vehicle headlight comprising the power converting transformer of claim 1.

10. A motor vehicle comprising the vehicle headlight of claim 9.

11. A power converting transformer, comprising:

a substantially rectangular flat I-core extending along an x-y plane in an xyz orthogonal coordinate system; and an E-core including a substantially rectangular flat base portion extending along the x-y plane, a central leg portion installed upright at a center of the base portion to extend in a z-direction, and a pair of outer leg portions installed upright in opposite end portions of the base portion in a y-direction to extend in the z-direction, the I-core placed on the outer leg portions, wherein the I-core includes a fit-in groove into which a fixing spring is fitted, the fit-in groove formed on a surface of the I-core opposite from a surface of the I-core facing the E-core, the E-core includes a pair of fixing recess portions provided on a surface of the base portion opposite from a surface of the base portion facing the I-core, the pair of fixing recess portions provided at centers in the x-direction of the opposite end portions of the base portion, the I-core and the E-core are pressed and fixed to each other by the fixing spring wrapped around the I-core and the E-core through the fit-in groove and the fixing recess portions, and an x-direction length of the E-core is shorter than an x-direction length of the I-core, a y-direction length of the E-core being shorter than a y-direction length of the I-core.

* * * * *